US006286568B1

(12) United States Patent
Araki et al.

(10) Patent No.: US 6,286,568 B1
(45) Date of Patent: Sep. 11, 2001

(54) TRANSPORTATION, FEEDING AND FILLING APPARATUS OF IRREGULAR-FORMED VESSELS AND TRANSPORTATION AND FEEDING METHOD

(75) Inventors: Yozo Araki; Kenji Mizukawa; Koichi Jinno, all of Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 83 days.

(21) Appl. No.: 09/604,254

(22) Filed: Jun. 27, 2000

Related U.S. Application Data

(62) Division of application No. 09/214,385, filed as application No. PCT/JP98/01976 on Apr. 30, 1998.

(30) Foreign Application Priority Data

Apr. 30, 1997 (JP) ..... 9-112416
Oct. 20, 1997 (JP) ..... 9-306463
Oct. 20, 1997 (JP) ..... 9-306464

(51) Int. Cl.[7] ..... B65B 43/42; B67C 3/00

(52) U.S. Cl. ..... 141/166; 141/129; 141/163; 141/165; 141/168; 141/10; 198/377.01; 198/377.02; 198/377.03; 198/395

(58) Field of Search ..... 141/10, 129, 163, 141/165, 166, 168; 198/377.01, 377.02, 377.03, 395

(56) References Cited

FOREIGN PATENT DOCUMENTS 2236181A 1/1973 (DE) .

(List continued on next page.)

*Primary Examiner*—Timothy L. Maust

(57) ABSTRACT

A plurality of bag making machines 2*a* and 2*b* for continuously producing irregular-formed vessels 1 having a flanged mouth plug, a plurality of transportation troughs 11*a* and 11*b* connected to the respective plurality of bag making machines 2*a* and 2*b*, a single-row transportation trough 4 for combining into a single row and transporting the irregular-formed vessels 1 fed from the respective transportation troughs 11*a* and 11*b*, and a plurality of relay movable troughs 15*a* and 15*b* capable of containing a predetermined amount of irregular-formed vessel from the corresponding transportation trough, and discharging the contained irregular-formed vessels to the single-row transportation trough are provided, a transportation disk 8 continuously rotating in a horizontal direction for taking up the mouth plug flange part from the tip of the transportation trough 4 and feeding the mouth-plugged irregular-formed vessel 1 to a continuously rotating rotary filling apparatus C is provided, the transportation disk 8 having an asymptotic plane 81*b* of a shape smoothly changing to a spiral curve, a hanging step 81*a* formed for taking up the mouth plug flange part, a vessel neck pressing lever 88 movably disposed for pressing the mouth plug flange part, and a holding spring (77) disposed between the transportation disk 8 and the lever 88, wherein the hanging step 81*a* and the set of the lever 88 and the holding spring 77 have a same pitch as that of grippers 7 of the rotary filling apparatus 5, and at a predetermined feeding position, a holding release cam 86 for swinging the lever 88 in a holding release direction of the mouth plug flange part is mounted on the continuously rotating rotary filling apparatus C, and having an intermittent swinging table 111 disposed above the continuous rotation table 5 and having a plurality of filling nozzles 121 at a same pitch as the vessel holding pitch, filling means for pushing out the liquid from the filling nozzles 121, vertical moving means for vertically moving the filling nozzles 121, a continuously rotating outside hollow shaft 119 to which the continuous rotation table 5 is mounted, a hollow shaft 116 disposed concentrically with the outside hollow shaft 119 for reciprocally rotating the intermittent swinging table 111.

4 Claims, 13 Drawing Sheets

FOREIGN PATENT DOCUMENTS

| | | |
|---|---|---|
| 2083345A | 12/1971 | (FR) . |
| 2281272A | 3/1995 | (GB) . |
| 50-024426Y1 | 7/1923 | (JP) . |
| 59-046874B2 | 11/1984 | (JP) . |
| 59-191304 U | 12/1984 | (JP) . |
| 63-055006A | 3/1988 | (JP) . |
| 63-281991A | 11/1988 | (JP) . |
| 1046375 | 10/1989 | (JP) . |
| 3043322A | 2/1991 | (JP) . |
| 3059921 U | 6/1991 | (JP) . |
| 4066414A | 3/1992 | (JP) . |
| 4367402A | 12/1992 | (JP) . |
| 5011183Y2 | 3/1993 | (JP) . |
| 5170252A | 7/1993 | (JP) . |
| 6032398A | 2/1994 | (JP) . |
| 6048401A | 2/1994 | (JP) . |
| 6199317A | 7/1994 | (JP) . |
| 7033194A | 2/1995 | (JP) . |
| 7110672B2 | 11/1995 | (JP) . |
| 7329903A | 12/1995 | (JP) . |
| 8187768A | 7/1996 | (JP) . |

(a) first pouch sensor, 21a
(b) feed of first vibrating transportation trough, 11a
(c) pouch stopper, 14a(I)
(d) first pusher, 13a
(e) second pouch sensor, 21b
(f) feed of second vibrating transportation trough, 11b
(g) pouch stopper, 14b(II)
(h) second pusher, 13b
(i) third pouch sensor, 22a
(j) fourth pouch sensor, 22b
(k) vibrating trough { trough sensor, 33a(II) / trough sensor, 33b(I) }
(m) third pusher, 18
(n) fifth pouch sensor, 23

TRANSPORTATION, FEEDING AND FILLING APPARATUS OF IRREGULAR-FORMED VESSELS AND TRANSPORTATION AND FEEDING METHOD

This application is a 371 of PCT/JP98/01976 filed Apr. 30, 1998.

This application is a divisional of co-pending application Ser. No. 09/214,385, filed on Dec. 30, 1998.

TECHNICAL FIELD

The present invention relates to a transportation apparatus of irregular-formed vessels, at a connection part between irregular-formed bag making machines and a filling apparatus, for combining a plurality of irregular-formed bag making machines having a relatively small production capacity with filling apparatus having a relatively high processing capacity, while feeding the irregular-formed vessels, an apparatus and a method for feeding unfilled plate-formed irregular vessels to the filling apparatus, and to a filling apparatus of irregular vessels for filling in the unfilled irregular vessels with a liquid, followed by capping the irregular vessels.

BACKGROUND ART

Since an irregular-formed vessel having a plug (that is, a bag-like vessel like a pouch) has an irregular form of the vessel itself, when handling the irregular vessel, the mouth opening is small in diameter, which is difficult to grip.

Then, to facilitate mechanical handling of irregular-formed vessel having such a mouth plug, a method is disclosed, for example, in Japanese Utility Model Publication 5-11183, in which a plurality of flange parts are provided at intervals at the mouth plug part of the vessel, the flange parts are engaged in an opening groove part of a C-sectioned elongate channel tool, so that the irregular-formed vessel is hang down on the channel tool through the flange part of the mouth plug part, thereby achieving storage and transportation of irregular-formed vessels.

Such an irregular-formed vessel (hereinafter called as "pouch"), after being produced by an irregular bag making machine, is fed to a filling apparatus where it is filled in with a predetermined content. The flange part can also be utilized when the pouch is carried from the bag making machine to the filling apparatus.

As described above, in transportation of the pouch from the bag making machine to the filling apparatus, for example, when the filling apparatus is low in capacity (30 to 50 bags/min), the bag making position and the filling position are separate from each other, and transportation between both positions is carried out using a transportation tool and a delivery box.

However, when a high-capacity filling apparatus is used, since the pouch transportation cost is increased and a large storage space becomes required, a requirement is increased for placing the bag making machine and the filling apparatus at the same position which are used in combination.

Further, when a transportation tool is used in pouch transportation, a cost is required for the tool, also when charging the vessels into the machine, a manual work or an automated machine for charging are required, resulting in an increased charging cost.

Still further, when the pouch is a food containing vessel, use of a transportation tool or a delivery box in the pouch transportation is not preferable in view of sanitation, since there is a danger of contamination of the tool or delivery box during transportation.

With a view to obviate the above prior art problems, an object of the present invention is to provide an irregular-formed vessel transportation apparatus and method which combines a plurality of low-capacity bag making machines with a high-capacity filling apparatus to achieve efficient transportation of pouch from the bag making machine to the filling apparatus.

In transporting the above pouch from the bag making machine to the filling apparatus which is a continuous rotary type, the vessel feeding method is generally of a type in which a conveyor, a timing screw having a feed groove conforming to the plane shape of the pouch, and a star wheel for taking the pouch over to the filling apparatus by coinciding the timing with the timing screw are combined.

However, for an irregular shape like a pouch which changes in shape by filling in with a liquid, the bags cannot be arranged and fed by a conventional conveyor, and since the head of the pouch is small for handling by the timing screw and the body shape is irregular that cannot be handled, it is impossible to utilize the vessel feeding method by the conveyor and the timing screw.

Yet further, since the bag-formed vessel like pouch is in the form of a flat plate before filling, it has an advantage that the vessels can be stored or transported by stacking, and utilizing the feature, an apparatus is developed which uniformly arranges directions of the vessels, feeds a stack of a plurality of vessels, and feeds the vessels one by one to the filling apparatus with correct timing by a vacuum sucking disk (for example, Japanese Patent Laid-open Publications 5-170252, 6-48401).

However, although the method of feeding the stacked pouches one by one to the filling apparatus by a vacuum sucking disk or the like is easily applied to a filling apparatus of an intermittent moving type, since it does not make continuous operation, the method is difficult to be applied to a continuously rotating rotary filling apparatus.

Even if a means for taking over the pouch following the movement of the filling apparatus can be used, there are problems of a low vessel feeding speed, requiring a plurality of feeding units for a high-capacity filling apparatus, and a complex layout, resulting in a high cost.

With the aim of eliminating the above prior art problems, another object of the present invention is to provide a feeding apparatus and feeding method of irregular vessels which can achieve continuous feeding of pouches suitable for continuously rotating rotary filling apparatus.

Further, as a filling apparatus for filling in fed unfilled pouches with a liquid and capping, an intermittent rotary filling apparatus in which a liquid filling part and a cap tightening part are mounted on the outer periphery of an intermittent rotation table, and a number of pouches held on the outer periphery of the table are filled up with the liquid and capped during one turn of the table does not use a rotary joint for liquid and air piping and electrical wiring and the like is possible to perform operations such as liquid filling, capping and the like with a simple apparatus as compared with a continuous rotating rotary filling apparatus which moves smoothly at a constant speed, however, since an intermittent operation must be performed matching the pitch time with the filling operation which requires the longest time in the operations of the filling part and the cap tightening part, the intermittent filling apparatus could be used only for applications of low filling capacity.

Therefore, a filling apparatus improved for the purpose of increasing the filling capacity while making use of the advantage of intermittent rotation is disclosed in Japanese Patent Publication 59-46874. This machine is provided with a member for supporting a plurality of filling nozzles which can perform liquid filling at a time in a plurality of pouches arranged on the periphery of a round table, the filling nozzle member can be moved along with the table during the time when the filling nozzle member moves from a specific start position on the table to an end point, after the filling nozzle is pulled out from the pouch at the end point on the table, the filling nozzle member is returned to the start position, where the filling nozzle is inserted into the pouch to begin liquid filling so that filling is completed until reaching the end point, and a sufficient filling time is ensured even when the pitch time of intermittent movement of the table is short, thereby improving the filling capacity.

As a filling apparatus for a pouch which changes in shape during liquid filling, there have been known a filling apparatus using an intermittent rotation table of a low speed (50 bags/min) as a transportation means as described above, or one which is disclosed in Japanese Patent Publication 59-46874 using a shortened pitch time of intermittent movement of the table as described above, however, although these are simple in structure and low-cost, since the transportation table makes an intermittent movement, high-speed intermittent movement cannot be performed to avoid liquid scattering during pouch transportation or falling down of pouch due to vibration, therefore improvement of filling capacity is limited.

With a view to eliminate the above prior art problems, it is a primary object of the present invention to provide a filling apparatus for irregular-formed vessels which eliminates intermittent movement of the transportation table and is high in filling capacity with a simple structure.

DISCLOSURE OF THE INVENTION

The irregular-formed vessel transportation apparatus according to the present invention comprises a plurality of bag making machines for continuously producing irregular-formed vessels each having a flanged mouth plug, a plurality of transportation troughs connected respectively to the plurality of bag making machines, a single-row transportation trough for combinedly transporting the irregular-formed vessels discharged from the respective transportation troughs in a single row, a plurality of relay movable troughs disposed corresponding to the plurality of transportation troughs, inlets being connected with outlets of corresponding transportation troughs by a predetermined movement for containing a predetermined amount of irregular-formed vessels from the corresponding transportation trough, and outlets being connected with an inlet of the single-row transportation trough by another predetermined movement for discharging the contained irregular-formed vessels to the single-row transportation trough, wherein when an outlet of any one of the plurality of relay movable troughs is connected with an inlet of the single-row transportation trough, movement of the plurality of relay movable troughs is cooperatively performed so that inlets of other relay movable troughs of the plurality of the relay movable troughs are connected with outlets of the transportation troughs respectively corresponding to the relay movable troughs.

The irregular-formed vessel transportation apparatus according to the present invention comprises a first bag making machine and a second bag making machine for continuously producing irregular-formed vessels each having a flanged mouth plug, a first transportation trough connected with the first bag making machine, a second transportation trough connected with the second bag making machine, a single-row transportation trough for combinedly transporting the irregular-formed vessels discharged from the first transportation trough and irregular-formed vessels discharged from the second transportation trough in a single row, a first relay movable trough having an inlet capable of being connected with outlet of the first transportation trough by a predetermined movement for containing a predetermined amount of irregular-formed vessels from the first transportation trough and having an outlet capable of being connected with inlet of the single-row transportation trough by another predetermined movement for discharging the contained irregular-formed vessels to the single-row transportation trough, and a second relay movable trough having an outlet capable of being connected with inlet of the single-row transportation trough by another predetermined movement for discharging the contained irregular-formed vessels to the single-row transportation trough, wherein the first relay movable trough and the second relay movable trough are constructed to cooperate with each other so that the second relay movable trough and the single-row transportation trough are connected when the first transportation trough is connected with the first relay movable trough and the first relay movable trough and the single-row transportation trough are connected when the second transportation trough is connected with the second relay movable trough .

The irregular-formed vessel transportation method according to the present invention uses a plurality of bag making machines for continuously producing irregular-formed vessels each having a flanged mouth plug, a plurality of transportation troughs connected respectively to the plurality of bag making machines, a single-row transportation trough for combinedly transporting the irregular-formed vessels discharged from the respective transportation troughs in a single row, a plurality of relay movable troughs disposed corresponding to the plurality of transportation troughs capable of containing a predetermined amount of irregular-formed vessels from the corresponding transportation trough and discharging the contained irregular-formed vessels to the single-row transportation trough, wherein one of the plurality of relay movable troughs is selected, the relay movable trough is moved to connect the output of the relay movable trough to the inlet of the single-row transportation trough to discharge the irregular-formed vessels contained in the relay movable trough to the single-row transportation trough, other of the plurality of the relay movable troughs are appropriately moved to be connected with output of the corresponding transportation trough for containing a predetermined amount of irregular-formed vessels from the transportation trough in the relay movable trough, while switching a relay movable trough selected from the plurality of relay movable troughs to be connected to the single-row transportation trough, the operation is repeated to successively transport a predetermined amount of irregular-formed vessels from the respective transportation troughs through the single-row transportation trough.

The irregular-formed vessel transportation method according to the present invention uses a first bag making machine and a second bag making machine for continuously producing irregular-formed vessels each having a flanged mouth plug, a first transportation trough connected with the first bag making machine, a second transportation trough connected with the second bag making machine, a single-row transportation trough for combinedly transporting the irregular-formed vessels discharged from the first transportation trough and irregular-formed vessels discharged from the second transportation trough in a single row, a first relay movable trough having an inlet capable of being connected with outlet of the first transportation trough by a predetermined movement for containing a predetermined amount of irregular-formed vessels from the first transportation trough and having an outlet capable of being connected with inlet of the single-row transportation trough by another predetermined movement for discharging the contained irregular-formed vessels to the single-row transportation trough, and a second relay movable trough having an outlet capable of being connected with inlet of the single-row transportation trough by another predetermined movement for discharging the contained irregular-formed vessels to the single-row transportation trough, wherein in a first operation, by a predetermined movement, an inlet of the first relay movable trough is connected to an output of the first transportation trough to contain a predetermined amount of irregular-formed vessels from the first transportation trough and, at the same time, an output of the second relay movable trough is connected to an inlet of the single-row transportation trough to discharge the irregular-formed vessels contained in the second relay movable trough to the single-row transportation trough, then, in a second operation, by another predetermined movement, the outlet of the first relay movable trough is connected to the inlet of the single-row transportation trough to discharge the irregular-formed vessels contained in the first relay movable trough to the single-row transportation trough and, at the same time, the inlet of the second relay movable trough is connected to the outlet of the second transportation trough to contain a predetermined amount of irregular-formed vessels from the second transportation trough into the second relay movable trough, and the first operation and the second operation are repeated to successively transport a predetermined amount of irregular-formed vessels from the first transportation trough and a predetermined amount of irregular-formed vessels from the second transportation trough in alternation through the single-row transportation trough.

Therefore, since transportation tools or delivery boxes as used in the prior art become needless, and a manual work or an automated charging machine for charging the vessels in the machine when using transportation tools or delivery boxes also becomes needless, and the bag making machine can be connected direct to the filling apparatus, the charging cost can be reduced and, by surrounding the entire apparatus by a clean booth, filling of the content can be performed under good sanitation. Therefore, when an irregular-formed vessel (pouch) with a wood plug is used for filling with a food, concern in sanitation can be eliminated. Further, when the vessel handling machine of the present invention is used midway in the transportation trough, a plurality of bag making machines can be connected directly to the filling apparatus, when a vibration transportation trough is used, since the vibration transportation trough has a vessel accumulation function, a small trouble in vessel transportation during operation can be eliminated.

The irregular-formed vessel feeding apparatus according to the present invention comprises a transportation trough for hanging down a mouth plug flange part of an irregular-formed vessel with a mouth plug and stacking the vessels arranged in a same direction of vessel bodies to transport it, a transportation disk continuously rotating in a horizontal direction for taking up the mouth plug flange part from the tip of the transportation trough and feeding the irregular-formed vessel with mouth plug to a continuously rotating rotary filling apparatus, the transportation disk having an asymptotic plane of a shape of cutting in towards the center side of the disk and smoothly changing to a spiral curve from the cut-in center-side bottom to the outer edge, a hanging step formed for taking up the mouth plug flange part, a vessel neck pressing lever movably disposed for pressing the mouth plug flange part to hold the mouth plug flange part in cooperation with the hanging step, and a holding spring disposed between the transportation disk and the vessel neck pressing lever for urging the vessel neck pressing lever towards a holding direction of the mouth plug flange part, wherein the hanging step and the set of the vessel neck pressing lever and the holding spring have a same pitch as that of a gripper of the continuously rotating rotary filling apparatus, and at the feeding position of irregular-formed vessels with mouth plug to the continuously rotating rotary filling apparatus, a holding release cam for moving the vessel neck pressing lever in a holding release direction of the mouth plug flange part is mounted on the continuously rotating rotary filling apparatus.

In the feeding method of a irregular-formed vessel with a mouth plug according to the present invention, the irregular-formed vessel with mouth plug taken up at a mouth plug flange part from a transportation trough for hanging the mouth plug flange part and stacking and transporting the vessels with vessel bodies arranged in a direction to a continuously rotating rotary filling apparatus using a transportation disk, the irregular-formed vessels with mouth plug fed to the continuously rotating rotary filling apparatus are taken up by a hanging step provided on the transportation disk having an asymptotic plane of a shape of smoothly changing to a spiral curve, then a vessel neck pressing lever movably mounted on the transportation disk for pressing the mouth plug flange part is pressed towards the mouth plug flange part by a holding spring disposed between the transportation disk and the vessel neck pressing lever to hold the mouth plug flange part inbetween, after that, when the irregular-formed vessel with mouth plug reaches a feeding position to the continuously rotating rotary filling apparatus, the vessel neck pressing lever is moved in a holding release direction by a holding release cam mounted on the continuously rotating rotary filling apparatus to feed the irregular-formed vessel with mouth plug to the continuously rotating rotary filling apparatus.

Therefore, with the feeding apparatus and method of irregular-formed vessels with mouth plug according to the present invention, since a vessel having a small head and an irregular-shaped body like the irregular-formed vessel with mouth plug cannot hang on a timing screw, although it has been difficult to feed the vessels with a correct feed timing to the continuously rotating rotary filling apparatus while maintaining the arranged direction of the vessels, after the vessel is fed in a pressed state while the mouth plug part being guided by the transportation trough, and the vessels are taken up at the mouth plug part from the transportation disk and fed one by one into the filling apparatus, a smooth vessel feed is possible as with the timing screw, and continuous feed of irregular-formed vessels with mouth plug to the continuously rotating rotary filling apparatus can be positively performed.

Further, since the mouth plug part of the vessel is held by the opening/closing vessel neck pressing lever, the direction of the irregular-formed vessel with mouth plug can be maintained, protecting the mouth plug part of the vessel from deviating to the asymptotic plane of the transportation disk, and the irregular-formed vessels be stably fed at a high speed.

The feeding apparatus of mouth-plugged irregular-formed vessels according to the present invention comprises a vessel sensor for detecting loaded state of the irregular-formed vessel in the transportation trough, and a vessel stopper for stopping forward movement of the vessel by pressing the vessel neck immediately before the head vessel in the transportation trough until the loaded state in the transportation trough by the detection signal of the vessel sensor is a predetermined state.

Therefore, with the feeding apparatus of mouth-plugged irregular-formed vessels according to the present invention, there is an advantage that by detecting the number of vessels on the transportation trough using the vessel sensor to control open/close timing of the vessel sensor, feeding pressure of the vessel row is regulated in an appropriate range for positive vessel feeding, thereby preventing generation of an excessive pressure towards the asymptotic plane of the transportation disk.

With the filling apparatus of irregular-formed vessels according to the present invention, the irregular-formed vessels continuously fed by the vessel feeding means are gripped at a constant pitch on the circumference of the continuous rotation table rotating on the horizontal plane, the irregular-formed vessels are filled up with a liquid, and filled vessels are discharged by vessel delivery means, comprising:

an intermittent swinging table disposed above the continuous rotation table and having a plurality of filling nozzles at a same pitch as the constant pitch, filling means for pushing out the liquid from the filling nozzles, vertical moving means for vertically moving the filling nozzles;

a continuously rotating outside hollow shaft to which the continuous rotation table is mounted;

a hollow shaft disposed concentrically with the outside hollow shaft for reciprocally rotating the intermittent swinging table;

forward movement of the intermittent swinging table by the hollow shaft synchronizes with rotation of the continuous rotation table, and return movement thereof is a quick return to the initial position of the gripped vessel of the continuous rotation table to coincide with the filling nozzle position;

the vertical moving means is operated by a vertical moving shaft penetrating in the hollow shaft, moves down in the forward movement of the intermittent swinging table, and moves up in the quick return, in the continuous rotation of the continuous rotation table, follow rotation of moving-down liquid filling nozzle and quick return to the initial position by upward movement are possible by the compact mechanism, thereby enabling high-speed continuous filling with a simple mechanism without vibration of liquid surface as seen in the intermittent operation.

With the filling apparatus of irregular-formed vessels according to the present invention, a capping device is disposed on the side of the continuous rotation table for supplying a vessel cap, a capping head is provided on the intermittent swinging table at a symmetrical position with the filling nozzle with respect to the concentric hollow shaft penetrating the outside hollow shaft, the capping head is provided in the same pitch as the gripped vessel of the continuous rotation table, the cap put on the vessel by the capping device mounted outside is chucked by the capping head moved down by the filling nozzle vertical moving means, after being tightened, moved up by quick return, repeating intermittent tightening, wherein the capping device is mounted on the intermittent swinging table opposite to the filling nozzle, which can also be used as the intermittent swinging table, enabling a simple structure, cables of the drive motor for rotating the capping head and the like can be disposed on the upper part and are not rotated, therefore complex structures such as rotary joint and slip joint are needless, resulting in simplified structure and reduced cost.

With the filling apparatus of irregular-formed vessels according to the present invention, the hollow shaft is connected to the outside hollow shaft drive means through an oscillating cam unit, the vertical moving shaft is linked to the outside hollow shaft drive means through the vertical moving cam, and the intermittent swinging table is connected to the vertical moving shaft, since the three operations of the rotation of the continuous rotation table, follow rotation/quick return and vertical movement of the intermittent swinging table are mechanically connected, they can be exactly synchronized, and drive of the swinging table can be optimized in terms of speed and acceleration.

With the filling apparatus of irregular-formed vessels according to the present invention, vertical movement of the vertical moving shaft is transmitted to a reverse rotation lever rotatably supported on the supporting shaft equal-number mounted to the filling nozzle and the capping head in the horizontal circumferential direction on the lower part of the intermittent swinging table, inside end part being connected through a disk mounted to the upper end part of the vertical moving shaft and a pin joint bar in the vertical direction, and the outside end part being provided with a roller, and to the filling nozzle and capping head vertically slidable on a vertical guide engaged with the roller of the reverse rotation lever and mounted on the swinging table, since in the vertical movement, weight of the drive shaft part, weight of the filling nozzles beyond the load reversing lever and the capping head are canceled, thereby enabling operation of reduced load variation.

With the filling apparatus of irregular-formed vessels according to the present invention, when using an irregular-formed vessel having a hard stepped neck for holding, a gripper for holding the vessel neck is mounted on the continuous rotation table, the vessel feeding apparatus support the vessel neck by an inclined parallel guide bar, takes out the vessels one by one by a vibration trough having a vibrator and a star wheel driven in synchronization from the same drive shaft as the continuous rotation table, and transfers it to the continuous rotation table, a filled vessel discharging apparatus takes out one by one by a star wheel synchronizedly driven from the same drive means as the continuous rotation table to transfer to a discharge conveyor, therefore, handling at a high speed is possible, the vibration trough has the same role as the screw of the prior art, and even a small article that cannot be handled by the screw can be handled.

With the filling apparatus of irregular-formed vessels according to the present invention, a rinser for spraying clean water is disposed between the liquid filling section outside of the continuous rotation table and the capping section for cleaning the outside of continuously transported filled vessels, or an ink-jet printing apparatus is disposed at a position immediately after vessel feeding of the continuous rotation table.

With the filling apparatus of irregular-formed vessels according to the present invention, the filling means is provided with an air passage open to the internal liquid passage, air piping of each filling nozzle is connected to a manifold mounted on the intermittent rotation table, between the manifold and an outer mounting member is connected with a flexible air piping, a 3-way valve for switching a vacuum air piping and a compressed air piping is connected to the outer mounting member, air in the vessel is evacuated to a negative pressure, after closing the air piping opening by compressed air, and a constant amount of liquid is charged into the vessel by measuring piston operation, filling is possible by a smaller number of filling nozzles and measuring units as compared with a continuous rotation filler, and, since the measuring part and the tank part are separately disposed, accessibility for cleaning and maintenance is good. Further, since a longer filling time is available compared with the prior art intermittent filler, high-capacity filling is possible.

BEST MODE FOR PRACTICING THE INVENTION

An embodiment of the present invention will be described in detail in the following.

Figure 1:
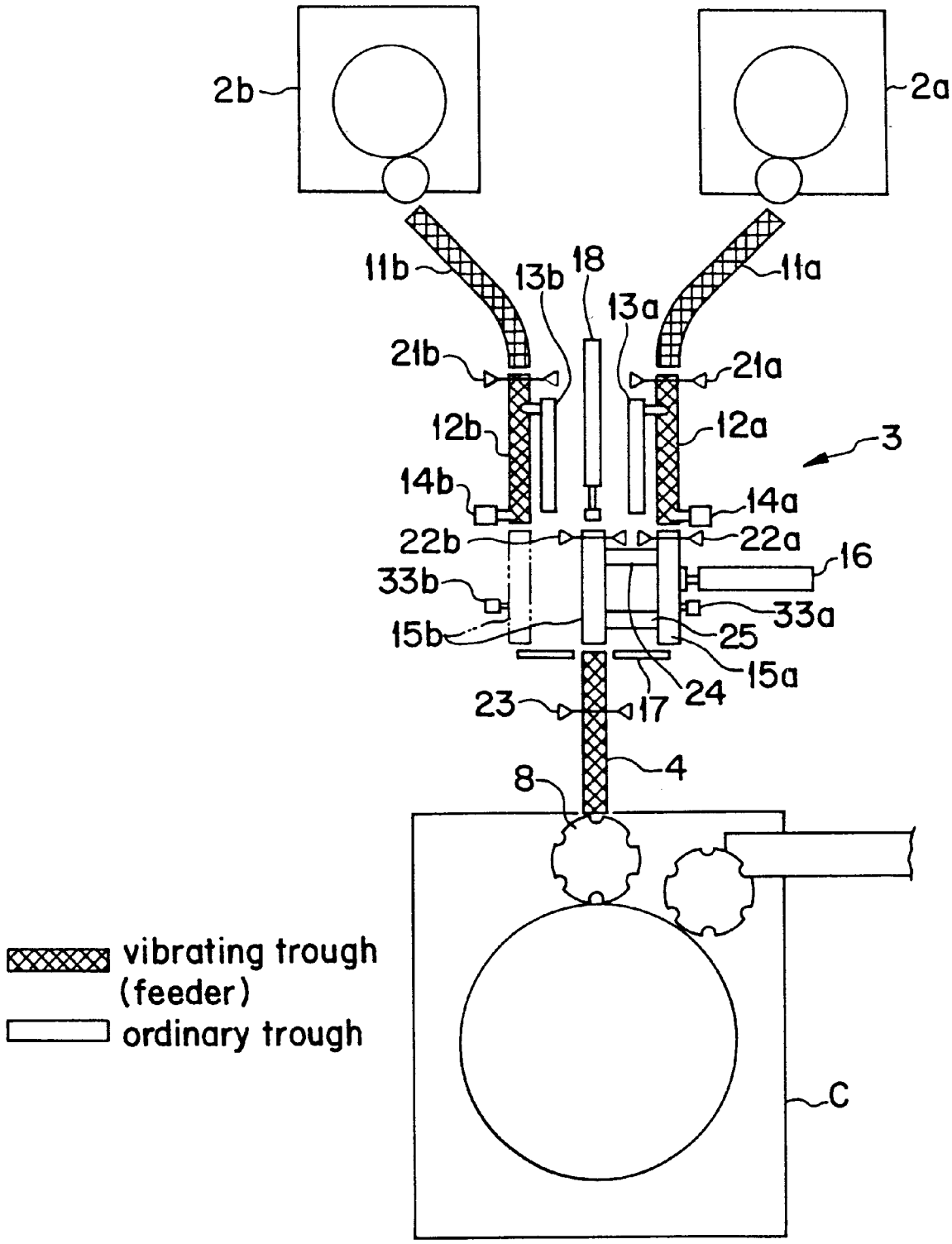
FIG. 1 is a schematic plane diagram (layout diagram) showing the entire structure of the transportation apparatus of irregular-formed vessels according to an embodiment of the present invention.
Figure 2:
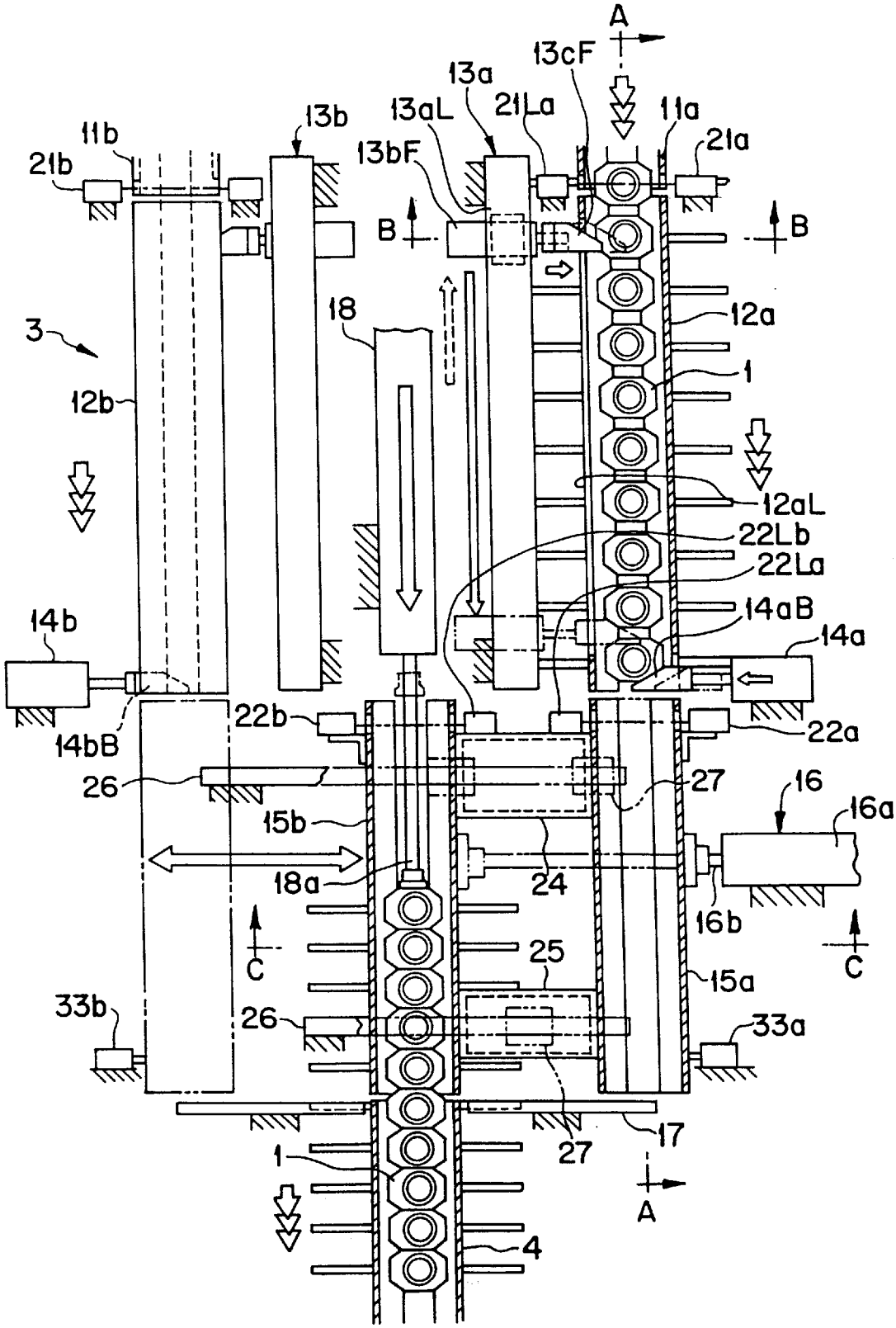
FIG. 2 is a schematic plane diagram showing the structure of part of the transportation apparatus of irregular-formed vessels according to an embodiment of the present invention.
Figure 3:
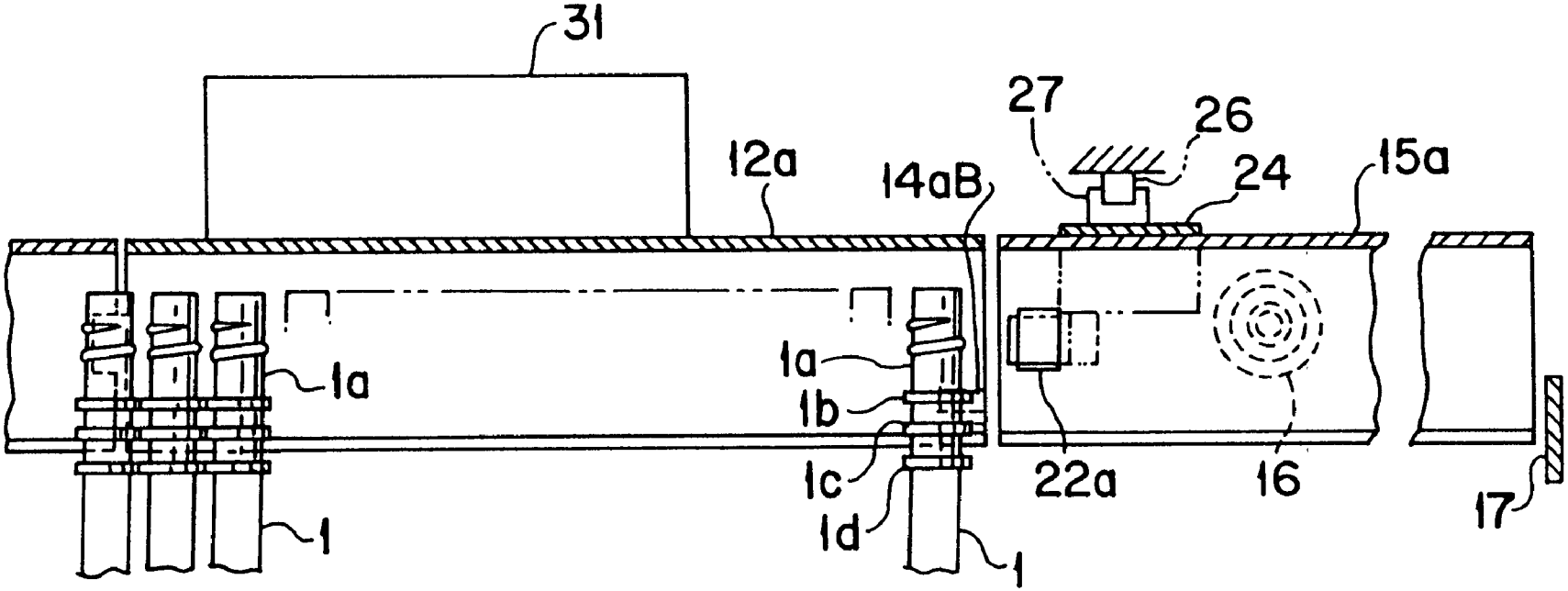
FIG. 3 is a schematic sectional diagram (A—A section of FIG. 2) showing the structure of part of the transportation apparatus of irregular-formed vessels according to an embodiment of the present invention.
Figure 4:
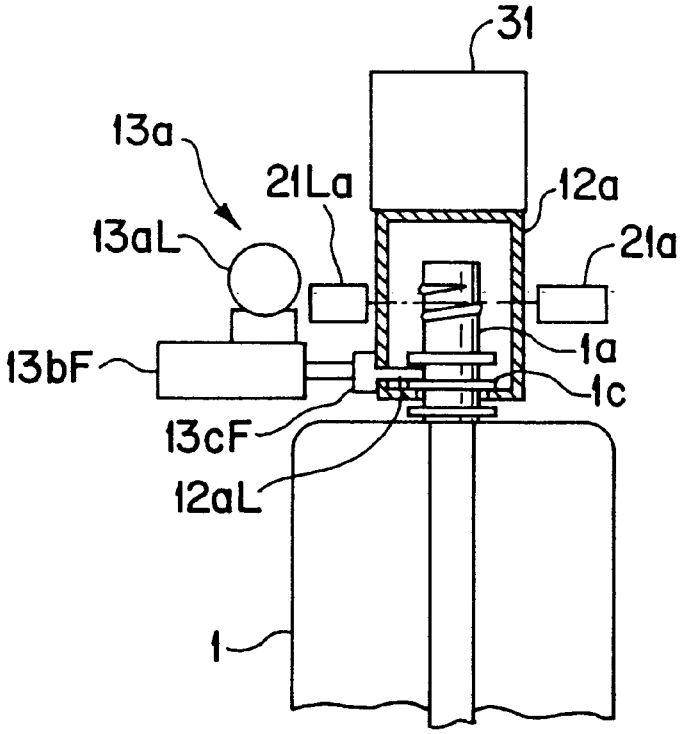
FIG. 4 is a schematic sectional diagram (B—B section of FIG. 2) showing the structure of part of the transportation apparatus of irregular-formed vessels according to an embodiment of the present invention.
Figure 5:
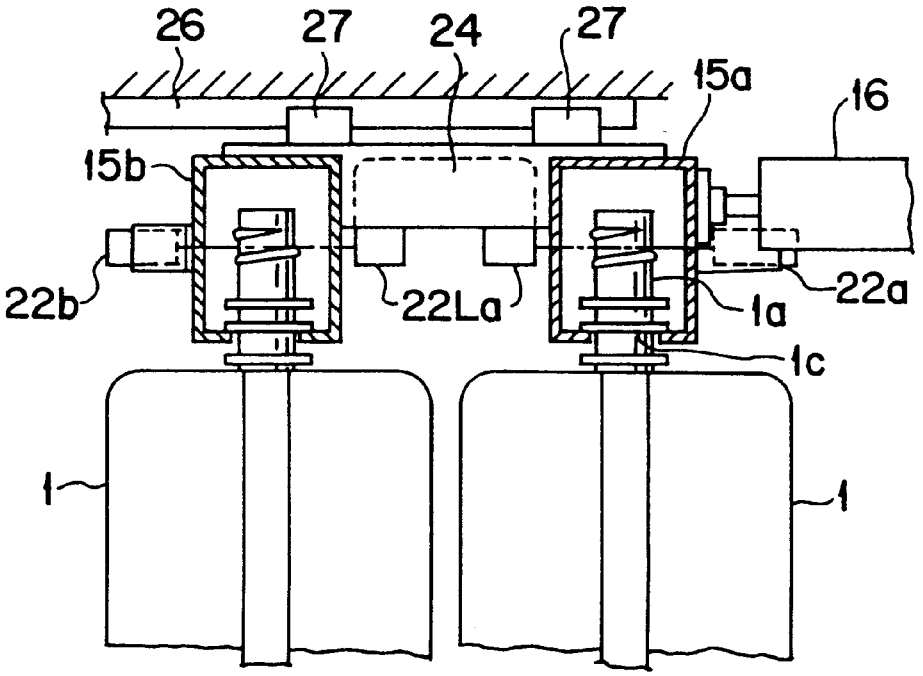
FIG. 5 is a schematic sectional diagram (C—C section of FIG. 2) showing the structure of part of the transportation apparatus of irregular-formed vessels according to an embodiment of the present invention.
Figure 6A:
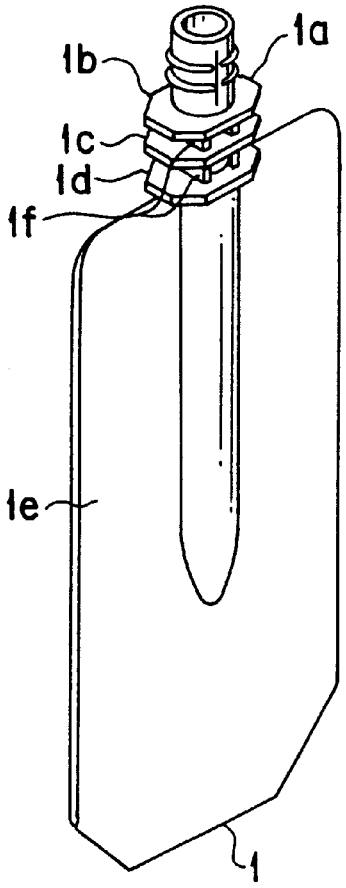
FIG. 6 is a schematic perspective diagram showing the irregular-formed vessel according to an embodiment of the present invention, in which (a) shows an unfilled state, and (b) shows a filled state.
Figure 6B:
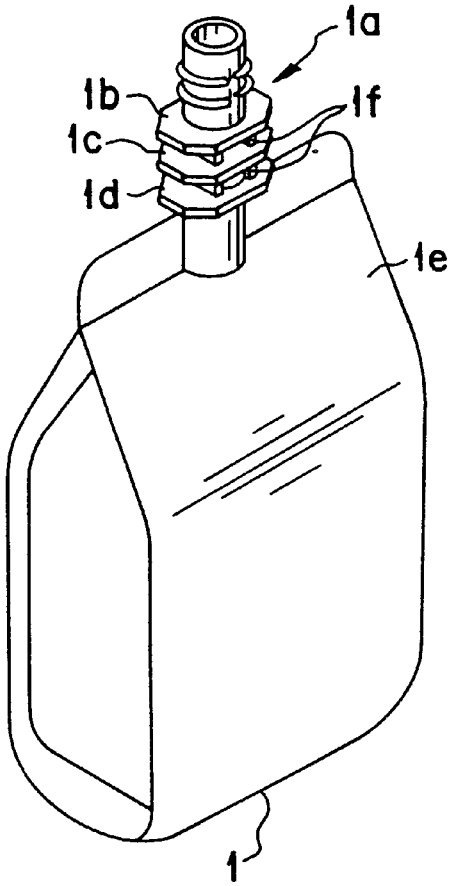
Figure 7:
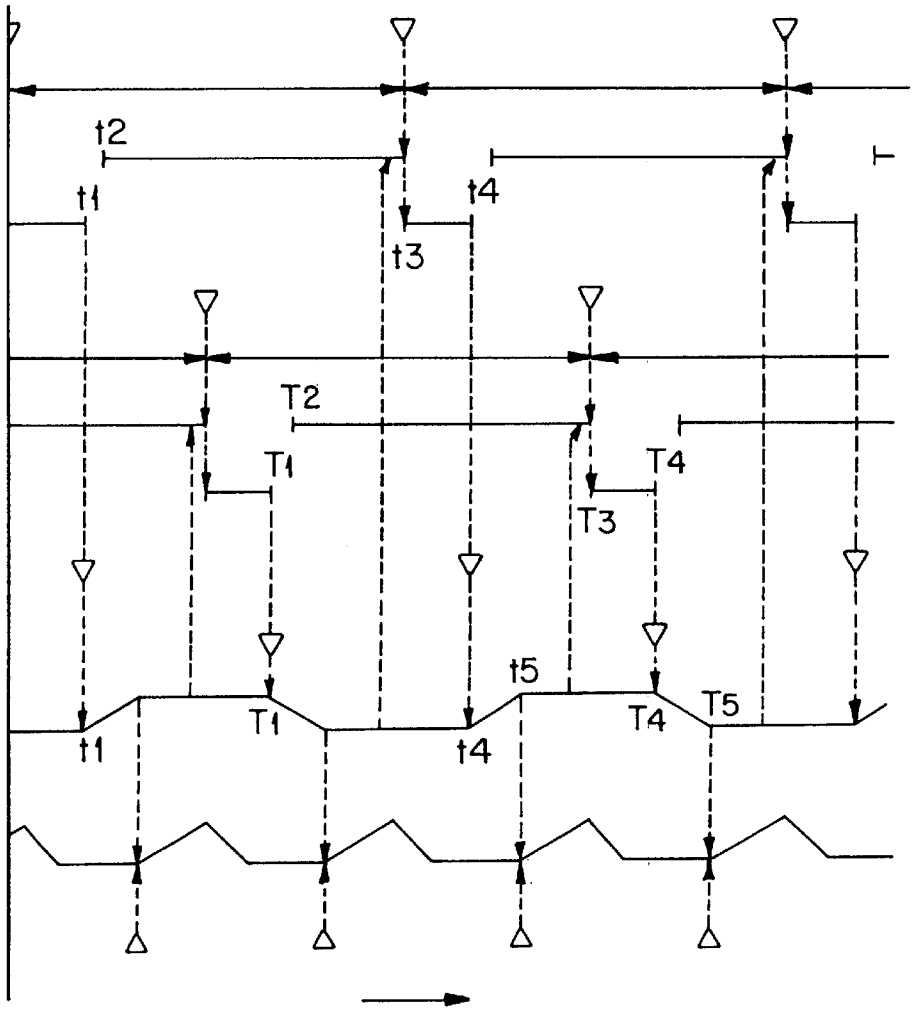
FIG. 7 is a time chart for explaining the transportation apparatus and method of irregular-formed vessels according to an embodiment of the present invention, in which (a) to (n) respectively show corresponding movements of respective subject matter of the apparatus.

FIGS. 1 to 7 explain the feeding apparatus and method of mouth-plugged irregular-formed vessels as an embodiment of the present invention, in which FIG. 1 a schematic plane diagram showing the entire structure, FIG. 2 is a schematic plane diagram showing the structure of part thereof, FIG. 3 is an A—A sectional diagram of FIG. 2, FIG. 4 is a B—B sectional diagram of FIG. 2, FIG. 5 is a C—C sectional diagram of FIG. 2, FIGS. 6(*a*) and 6(*b*) are schematic diagrams showing an irregular-formed vessel, and FIG. 7 is a time chart showing an example of the operation.

The present embodiment relates to an apparatus and method for feeding mouth-plugged irregular-formed vessels (pouches) supplied from two irregular-formed vessel (pouch) making machines of relatively small processing capacity to a pouch filling apparatus of relatively large processing capacity.

A pouch 1 as an irregular-formed vessel transported in the present embodiment is constructed as shown, for example, in FIGS. 6(*a*) and (*b*), a mouth plug part (neck part) 1*a* thereof is provided with an upper flange 1*b*, a middle flange 1*c*, and a lower flange 1*d*, and a body part 1*e* is formed at the lower side. FIG. 6(*a*) shows the pouch 1 in an unfilled state in the body part 1*e*, and FIG. 6(*b*) shows the pouch 1 in a filled state with a predetermined content in the body part 1*e*.

Between each other of these flanges 1*b*, 1*c*, and 1*d*, a plurality of opposing guide surfaces 1*f* are oppositely provided. When the pouch 1 is transported, these opposing side surfaces 1*f* are held to regulate the moving direction of the pouch 1 in a predetermined direction.

This transportation apparatus is constructed as shown in FIGS. 1 to 5. In the following, the apparatus will be described with reference mainly to FIGS. 1 and 2, and appropriately to FIGS. 3 to 5.

Specifically, as shown in FIG. 1, the transportation apparatus comprises a first bag making machine 2*a* and a second bag making machine 2*b* for continuously producing the pouch 1 as an irregular-formed vessel having a flanged mouth plug. As these first and second bag making machines 2*a* and 2*b*, those which have the same production capacities are disposed in parallel to deliver the pouch 1 at the same speeds.

To combine the pouch 1 produced by the first bag making machine with the pouch 1 produced by the second bag making machine into a single row, a pouch combining transportation apparatus 3 is provided at the downstream side of the transportation passage of the bag making machines 2*a* and 2*b* and, further, a single-row trough 4 for feeding the pouch 1 combined into the single row to a filling apparatus C is provided at the downstream side of the pouch combining transportation apparatus 3.

Of these, the pouch combining transportation apparatus 3 is provided with, sequentially from the upstream side of transportation passage, a first vibrating transportation trough 11*a* and a second vibrating transportation trough 11*b*, a third vibrating transportation trough 12*a* and a fourth vibrating transportation trough 12*b*, a first relay swinging trough (first relay movable trough) 15*a* and a second relay swinging trough (second relay movable trough) 15*b*.

That is, the first bag making machine 2*a* is connected with the first vibrating transportation trough (pouch feeder) 11*a* for transporting the pouch 1 produced by the first bag making machine 1*a*, and similarly, the second bag making machine 2*b* is connected with the second vibrating transportation trough (pouch feeder) 11*b* for transporting the pouch 1 produced by the second bag making machine 2*b*.

These first and second vibrating transportation troughs 11*a* and 11*b* are symmetrically disposed while being curved in planar state (FIG. 1) to approach each other at the downstream side, each hangs the pouch 1 at the middle flange 1*c* of the mouth plug part 1*a* to be guided through a guide side surface 1*f* to arrange the direction of the body part of the pouch 1 and transported by vibration in the feeding direction.

At the downstream side of these first vibrating transportation trough 11*a* and second vibrating transportation trough 11*b*, a first arrange measuring transportation trough 12*a* and a second arrange measuring transportation trough 12*b* formed linearly and in parallel to each other are provided as shown in FIGS. 1 and 2.

These first and second arrange measuring transportation troughs 12*a* and 12*b* also hang the pouch at the middle flange 1*c* of the mouth plug part 1*a* to be guided through a guide side surface 1*f* to arrange the direction of the body part of the pouch 1 and transported by vibration in the feeding direction.

As shown in FIGS. 2 and 4, an inlet part of the first arrange measuring transportation trough 12*a* and the second arrange measuring transportation trough 12*b* is provided with a first pouch sensor 21*a* and a second pouch sensor 21*b* for confirming that the pouch 1 is fully loaded on the respective arrange measuring transportation troughs 12*a* and 12*b*.

These pouch sensors 21*a* and 21*b* are fixed to an outer fixing member (not shown) which is not directly connected to the arrange measuring transportation troughs 12*a* and 12*b* so that they are not affected by vibration of the arrange measuring transportation troughs 12*a* and 12*b*.

Such pouch sensors 21*a* and 21*b* are optical sensors capable of sensing light from a light source, at the inlet part of the first arrange measuring transportation trough 12*a* and the second arrange measuring transportation trough 12*b*, these first and second pouch sensors 21*a* and 21*b*, and light sources 21La and 21Lb disposed to oppose the pouch sensors 21*a* and 21*b* are provided.

It is constructed so that the mouth plug part 1*a* of the pouch 1 coming into the arrange measuring transportation troughs 12*a* and 12*b* passes between the pouch sensors 21*a* and 21*b* and the light sources 21La and 21Lb, when light from the light sources 21La and 21Lb is blocked by the mouth plug part 1*a* and cannot be received by the pouch sensors 21*a* and 21*b*, and the light blocked state continues for more than a predetermined period of time, a signal (full-load signal) indicating that the pouch 1 is fully loaded on the transportation troughs 12*a* and 12*b* is outputted from the pouch sensors 21*a* and 21*b*.

When light from the light sources 21La and 21Lb is blocked by the pouch 1 for a short time (that is, light blocking is not continued for more than the predetermined time), it is set so that the pouch sensors 21*a* and 21*b* do not output the full-load signal.

Further, at the respective downstream side of the first arrange measuring transportation trough 12*a* and the second arrange measuring transportation trough 12*b*, pouch stoppers 14*a* and 14*b* to hold the pouch 1 in the arranged state are provided.

These pouch stoppers 14*a* and 14*b* are mounted to an outer fixed member so as not to disturb vibration of the first and second arrange measuring transportation troughs 12*a* and 12*b*, these pouch stoppers 14*a* and 14*b* are provided with stopper bars 14*a*B and 14*b*B which are forward and backward driven by an air actuator (not shown), when the stopper bars 14*a*B and 14*b*B are forward driven to protrude, the tip of the stopper bars 14*a*B and 14*b*B stops movement of the pouch 1 to maintain the predetermined arrangement state.

Therefore, in the state where the pouch stoppers 14*a* and 14*b* protrude the stopper bars 14*a*B and 14*b*B to stop movement of the pouch 1, the pouches 1 successively fed from the vibrating transportation troughs 11*a* and 11*b* side are arranged in the arrange measuring transportation troughs 12*a* and 12*b* until full-load state.

When the full-load state is established, light from the light sources 221La and 21Lb to the pouch sensors 21*a* and 21*b* is blocked continuously for the predetermined time by the mouth plug part 1*a* of the last of the pouch row arranged with flange parts closely contacted. Therefore, in this case, the pouch sensors 21*a* and 21*b* confirms that the photoelectric signal is blocked continuously for the predetermined time and outputs a full-load control signal.

Even in the state when the pouch row is moving forward, light from the light sources 21La and 21Lb is blocked by the passage of the pouch 1, since this blocking is for a short time (that is, light blocking does not continue for more than the predetermined time), the pouch sensors 21*a* and 21*b* do not output the full-load signal of the pouch 1. Therefore, when the pouch 1 merely passes through during forward movement of the row, mis-detection of full-load state is prevented.

At the side of the first arrange measuring transportation trough 12*a* and the second arrange measuring transportation trough 12*b*, a first pusher 13*a* and a second pusher 13*b* extending from the upstream side to the downstream side are provided.

These first and second pushers 13*a* and 13*b* are respectively provided with a rodless cylinder 13*a*L, a finger cylinder 13*b*F and a finger 13*c*F.

The finger 13*c*F is forward and backward driven by the finger cylinder 13*b*F into the passage of the corresponding arrange measuring transportation troughs 12*a* and 12*b*, so that when the finger 13*c*F is protruded, the finger 13*c*F is engaged with the back surface of the arranged pouch 1.

Further, the finger 13*c*F is driven by the rodless cylinder 13*a*F from the upstream side to the downstream side of the arrange measuring transportation troughs 12*a* and 12*b*, when the finger 13*c*F is driven at a predetermined timing from the upstream side to the downstream side of the arrange measuring transportation troughs 12*a* and 12*b*, the finger 13*c*F pushes out the pouches 1 arranged in the first arrange measuring transportation trough 12*a* or the second arrange measuring transportation trough 12*b* at a stroke towards the first relay swinging trough 15*a* or the second relay swinging trough 15*b*.

Still further, on the side wall of the arrange measuring transportation troughs 12*a* and 12*b*, a slot 12*a*L extending in the longitudinal direction thereof is formed, the finger 13*c*F moves from the slot 12*a*L into the arrange measuring transportation troughs 12*a* and 12*b*, and forward and backward driven by the finger cylinder 13*b*F between a retreat position where movement of the pouch 1 into the arrange measuring transportation troughs 12*a* and 12*b* is not disturbed and a forward position where the pouches 1 arranged in the transportation troughs 12*a* and 12*b* can be pushed out towards the relay swinging troughs 15*a* and 15*b*.

That is, in the first and second relay swinging troughs 15*a* and 15*b*, by predetermined swinging, inlets thereof are connected to outlets of the first and second vibrating transportation troughs 11*a* and 11*b*, and a predetermined amount of pouches 1 can be contained from the first and second vibrating transportation troughs 11*a* and 11*b,* by another predetermined swinging, outlets thereof are connected to the inlet of the single-row transportation trough 4, thereby feeding the contained pouches 1 to the single-row transportation trough 4.

The first relay swinging trough 15*a* and the second relay swinging trough 15*b* can perform respective predetermined swinging. In the present embodiment, the movement of the relay swinging troughs 15*a* and 15*b* is carried out by swinging, however, alternatively, a moving method other than swinging may be used.

That is, the first relay swinging trough 15*a,* by its predetermined swinging (that is, swing to the right direction in FIG. 2), is matched on the same straight line as the first arrange measuring transportation trough 12*a* at the downstream side of the first arrange measuring transportation trough 12*a,* and by the other predetermined swinging (that is, swing to the left direction in FIG. 2), matched on the same straight line as the single-row transportation trough 4 at the upstream side of the single-row transportation trough 4.

Further, the second relay swinging trough 15*b,* by its predetermined swinging (that is, swing to the left direction in FIG. 2), is matched on the same straight line as the second arrange measuring transportation trough 12*b* at the downstream side of the first arrange measuring transportation trough 12*b,* and by the other predetermined swinging (that is, swing to the right direction in FIG. 2), matched on the same straight line as the single-row transportation trough 4 at the upstream side of the single-row transportation trough 4.

In the present embodiment, these first relay swinging trough 15*a* and the second relay swinging trough 15*b* are fixed in a separate state with the following predetermined spacing by a connection member 24 and a connection member 25.

That is, it is constructed that a shaft center line distance between the first relay swinging trough 15*a* and the second relay swinging trough 15*b* is ½ the shaft center line distance between the first arrange measuring transportation trough 12*a* and the second arrange measuring transportation trough 12*b*.

Further, the single-row transportation trough 4 is disposed at a position of ½ the shaft center line distance between the first arrange measuring transportation trough 12*a* and the second arrange measuring transportation trough 12*b,* that is, at a position of equal distance from both the first arrange measuring transportation trough 12*a* and the second arrange measuring transportation trough 12*b* in a direction parallel to the first and second arrange measuring transportation troughs 12*a* and 12*b* and the first and second relay swinging troughs 15*a* and 15*b*.

With this construction, when the first relay swinging trough 15*a* and the first arrange measuring transportation trough 12*a* are on the same straight line, the second relay swinging trough 15*b* and the single-row transportation trough 4 are positioned on the same straight line, and when the second relay swinging trough 15*b* and the second arrange measuring transportation trough 12*b* are on the same straight line, the first relay swinging trough 15*a* and the single-row transportation trough 4 are positioned on the same straight line.

Therefore, as indicated by solid lines in FIG. 2, when the relay swinging troughs 15*a* and 15*b* swing to the right side, the first arrange measuring transportation trough 12*a* and the first relay swinging trough 15*a* are connected, and the second relay swinging trough 15*b* and the single-row transportation trough 4 are connected.

Further, as indicated by dotted lines in FIG. 2, when the relay swinging troughs 15*a* and 15*b* swing to the left side, the second arrange measuring transportation trough 12*b* and the second relay swinging trough 15*b* are connected, and the first relay swinging trough 15*a* and the single-row transportation trough 4 are connected.

To integrally swing the relay swinging troughs 15*a* and 15*b,* a moving cylinder 16 is provided. In the moving cylinder 16, a cylinder 16*a* thereof is fixed to an outer fixing member (not shown), and a piston rod 16*b* thereof is linked to the relay swinging trough 15.

Still further, the connection member 24 and the connection member 25 are provided with a linear bearing 27, and the linear bearing 27 engages with a linear guide 26 mounted to an outer fixing member, so that swing of the relay swinging troughs 15*a* and 15*b* by the moving cylinder 16 can be smoothly performed by these linear bearing 27 and linear guide 26.

Yet further, these first and second relay swinging troughs 15*a* and 15*b* are detected for the right side swing position by a swing trough sensor 33*a,* and the left side swing position by a swing trough sensor 33*b,* so that the first and second relay swinging troughs 15*a* and 15*b* are stopped swinging at a predetermined position according to a detection signal of the swing trough sensors 33*a* and 33*b*.

In the vicinity of the pouch inlets of the first relay swinging trough 15*a* and the second relay swinging trough 15*b,* as shown in FIG. 2 and FIG. 5, a third pouch sensor 22*a* and a fourth pouch sensor 22*b* are fixed to an outer fixing member, so that completion of containing a predetermined amount of pouches 1 from the arrange measuring transportation troughs 12*a* and 12*b* is detected by the pouch sensors 22*a* and 22*b*.

These pouch sensors 22*a* and 22*b* are optical sensors same as the first and second pouch sensors 21*a* and 21*b,* the respective sensors 22*a* and 22*b* are provided with opposing light sources 22La and 22Lb, so that the mouth plug part 1*a* of the pouch 1 coming in the relay swinging troughs 15*a* and 15*b* passes over light of the light sources 22La and 22Lb. Therefore, when the pouch 1 comes into the relay swinging troughs 15*a* and 15*b,* passage of the mouth plug part 1*a* is detected by the pouch sensors 22*a* and 22*b*.

Yet further, at a further upstream side position of the first swinging trough 15*a* and the second swinging trough 15*b* when being connected with the single-row transportation trough 4, a single-row loading pusher 18 is provided. The single-row loading pusher 18 pushes out the pouches 1 contained in the first swinging trough 15*a* or the second swinging trough 15*b* positioned on the same straight line as the single-row transportation trough 4 to drive them towards the single-row transportation trough 4 to load them in the state of a single row on the single-row transportation trough 4.

Yet further, as shown in FIG. 1, a fifth pouch sensor 23 is provided halfway in the single-row transportation trough 4. The pouch sensor 23 detects a pouch 1 loading state on the single-row transportation trough 4, which stops operation of the third pusher 18 when an excess amount of pouches 1 are loaded on the single-row transportation trough 4 to stop transportation in respective transportation trough.

Yet further, all of the above-described first vibrating transportation trough 11*a,* the second vibrating transportation trough 11*b,* the first arrange measuring transportation trough 12*a,* and the second arrange measuring transportation trough 12*b* and the single-row transportation trough 4 carry out transportation by vibration by a vibrator 31 or the like.

That is, the vibrator 31 is mounted on the upper part of the first arrange measuring transportation trough 12*a,* the vibrator 31 vibrates the first arrange measuring transportation trough 12*a* to feed the pouch 1 in the right direction of FIG. 3.

Yet further, at the pouch outlet side of the first relay swinging trough 15*a* and the second relay swinging trough 15*b,* a stopper plate 17 fixed to an outer fixing member is provided, to regulate the pouches 1 loaded from the relay swinging trough 15*a* and the second relay swinging trough 15*b* not to go out, other than when the relay swinging troughs 15*a* and 15*b* are in the position to communicate with the single-row transportation trough 4.

Yet further, a filling apparatus C disposed at the outlet side of the single-row transportation trough 4 is provided with a star wheel 8, filling apparatus C receives the pouches 1 from the single-row transportation trough 4 through the star wheel.

Since the irregular-formed vessel transportation apparatus as an embodiment of the present invention is constructed as described above, transportation operation is carried out using the procedures (methods) as shown, for example, in the time chart of FIG. 7.

In FIG. 7, characteristic (a) indicates operation of the first pouch sensor 21*a,* characteristic (b) is operation of the first vibrating transportation trough 11*a,* characteristic (c) is operation of the pouch stopper 14*a,* characteristic (d) is operation of the first pusher 13*a,* characteristic (e) is operation of the second pouch sensor 21*b,* characteristic (f) is operation of the second vibrating transportation trough 11*b,* characteristic (g) is operation of the pouch stopper 14*b,* characteristic (h) is operation of the second pusher 13*b,* characteristic (i) is operation of the pouch sensor 22*a,* characteristic (j) is operation of the pouch sensor 22*b,* characteristic (k) is operation of the swing trough sensors 33*a* and 33*b,* characteristic (m) is operation of the single-row loading pusher 18, and characteristic (n) is operation of the pouch sensor 23.

Further, in FIG. 7, detection operation of sensor is shown by ▽, Δ, drive and stop operation of pouch 1 by a solid line or a curved line.

The graph in FIG. 7 is performed by driving the first pusher 13*a* as shown in characteristic (d). Driving begins from halfway in the containing operation of pouch 1 from the third arrange measuring transportation trough 12*a* to the first relay swinging trough 15*a*.

As shown in FIG. 7, after completion of operation of the first pusher 13*a* at time $t_1$, at time $t_2$, at the tip of the first arrange measuring transportation trough 12*a,* protrusion operation of the pouch stopper 14*a* to the pouch passage is started. By this operation, in the first arrange measuring transportation trough 12*a,* the tip of the pouch 1 row becomes stoppable by the pouch stopper 14*a*.

Then, as shown in characteristic (b), transportation of pouch 1 to the first arrange measuring transportation trough 12*a* is performed in the first vibrating transportation trough 11*a*.

Next, when transportation of pouch 1 to the first arrange measuring transportation trough 12*a* is completed, as shown in characteristic (c) and characteristic (d), retreat (release of protrusion) of the pouch stopper 14*a* and drive of the first pusher 13*a* are performed at time $t_9$. This drives the finger 13*c*F of the first pusher 13*a* to contain pouch 1 from the first arrange measuring transportation trough 12*a* to the first relay swinging trough 15*a*.

When the pouch sensor 22*a* detects completion of containing to the first relay swinging trough 15*a* [characteristic (i)] at time $t_4$, swing of the first relay swinging trough 15*a* to the left side in FIG. 2 by the moving cylinder 16 is performed to complete the swing at time $t_5$ [characteristic (k)].

Operation of the single-row loading pusher 18 is started [characteristic (m)] at time $t_6$, and loading of pouch 1 from the first relay swinging trough 15*a* to the single-row transportation trough 4 is performed at a high speed.

On the other hand, with an eye on the system of the second vibrating transportation trough (pouch feeder) 11*b,* the second arrange measuring transportation trough 12*b,* and the second relay swinging trough 15*b,* at the start of the graph, as shown in characteristic (m), the single-row loading pusher 18 pushes out the pouch 1 from the second relay swinging trough 15*b* to the single-row transportation trough 4 for loading and, thereafter, retreat return operation is performed.

At this moment, in the second vibrating transportation trough 11*b,* transportation of pouch 1 to the second arrange measuring transportation trough 12*b* is performed simultaneously.

After operation of the second pusher 13*b* is completed [characteristic (h)] at time $T_1$, at time $T_8$, protrusion operation of the pouch stopper 14*b* to the pouch passage at the tip of the second arrange measuring transportation trough 12*b* is started [characteristic (g)], in the second arrange measuring transportation trough 12*b,* the tip of the pouch 1 row becomes stoppable by the pouch stopper 1*ba*.

Then, as shown in characteristic (f), transportation of pouch 1 to the second arrange measuring transportation trough 12*b* is performed in the second vibrating transportation trough 11*b*.

Next, when transportation of pouch 1 to the second arrange measuring transportation trough 12*b* is completed, as shown in characteristic (g) and characteristic (h), retreat (release of protrusion) of the pouch stopper 14*b* and drive of the second pusher 13*b* are performed at time $t_9$, thereby containing pouch 1 from the second arrange measuring transportation trough 12*b* to the second relay swinging trough 15*b*.

When the pouch sensor 22*b* detects completion of containing to the second relay swinging trough 15*b* [characteristic (j)] at time $T_4$, swing of the second relay swinging trough 15*b* to the right side in FIG. 2 by the moving cylinder 16 is performed to complete the swing at time $T_5$ [characteristic (k)].

Operation of the single-row loading pusher 18 is started [characteristic (m)] from time $T_5$, and loading of pouch 1 from the second relay swinging trough 15*b* to the single-row transportation trough 4 is performed at a high speed.

The above-described operation is repeatedly performed.

As described above, operation relating to the first arrange measuring transportation trough 12*a* and the first relay swinging trough 15*a,* and operation relating to the second arrange measuring transportation trough 12*b* and the second relay swinging trough 15*b* are performed in alternation.

By the above operation, the row of pouch 1 fed from the first vibrating transportation trough 11*a* through the first relay swinging trough 15*a* and the row of pouch 1 fed from the second vibrating transportation trough 11*b* through the second relay swinging trough 15*b* are loaded in alternation, thereby smoothly combining the rows of pouch 1 fed from the two bag making machines.

Since feeding speed of pouch 1 by the pushers 13*a,* 13*b,* and 18 is several times faster than feeding speed of pouch 1 in the respective transportation troughs, and drive speed of the moving cylinder 16 can be substantially increased, a sufficient stand-by time can be taken after feed of pouch by the pusher until returning to the original stand-by position where the transportation trough is fully loaded with pouches, thereby enabling continuous operation of the transportation trough and improving the operation rate.

Further, full-load of pouch to the first arrange measuring transportation trough 12*a* and the second arrange measuring transportation trough 12*b* is confirmed by the first pouch sensor 21*a* and the second pouch sensor 21*b*, full-load of pouch to the first relay swinging trough 15*a* and the second relay swinging trough 15*b* is confirmed by the pouch sensor 22*a* and the pouch sensor 22*b*, and the stop position of the swinging troughs 15*a* and 15*b* can be confirmed by the swing trough sensor 33*a* and the swing trough sensor 33*b*, misoperation in the operation control of combination transportation can be prevented.

By making the above pouch handling, since feed of pouch 1 from the mouth-plugged pouch making machines 2*a* and 2*b* of small production capacity can be made to the filling apparatus C of large processing capacity in the double-increasing state, single-row feed of pouch 1 is possible at a high speed.

In the present embodiment, since when an excess of pouch 1 is loaded on the single-row transportation trough 4, it is detected by the pouch sensor 23*a* which stops operation of the third pusher 18, and stops transportation in the respective trough, there is an advantage that malfunction due to excess load on the single-row transportation trough 4 is prevented.

Further, in the present embodiment, since all of the first and second vibrating transportation troughs 11*a* and 11*b*, the first and second arrange measuring transportation troughs 12*a* and 12*b*, and the single-row transportation trough 4 are constructed to perform transportation of mouth-plugged irregular-formed vessel (pouch) 1, there is an advantage that transportation of pouch 1 can be performed very smoothly even in a curved transportation passage, for example, as the vibrating transportation troughs 11*a* and 11*b*, and, on the contrary, when using the vibrating transportation trough, there is an advantage that since one which has a curvature can be applied as the transportation trough, layout of components is flexible and easy.

Naturally, these transportation troughs are not limited to those using vibration, any transportation trough not using vibration can be sufficiently applied if it performs smooth slide between the transportation trough and the vessel (pouch).

Further, since, in the present embodiment, two relay swinging troughs (relay movable troughs) 15*a* and 15*b* are provided which are connected to cooperate, these relay movable troughs 15*a* and 15*b* can be cooperated by a single actuator (moving cylinder 16) to achieve efficient operation, however, these relay movable troughs 15*a* and 15*b* are sufficient if they cooperate, and are not always necessary to be connected.

Further, in the present embodiment, two sets of vibrating transportation trough, relay measuring transportation trough, and relay movable trough are provided, however, when more sets of these vibrating transportation trough, relay measuring transportation trough, and relay movable trough are provided, and any one of a plurality (three or more) of the relay movable troughs is moved onto the same straight line as the single-row transportation trough 4, other relay movable troughs may be disposed on the same straight line as the corresponding arrange measuring transportation troughs, and an appropriate relay movable trough be moved, so that the relay movable trough moving on the same straight line as the single-row transportation trough 4 is switched in turn.

By making such handling of the mouth-plugged vessels, feed of pouch 1 from a small plurality (three or more) mouth-plugged pouch making machines can be made to the filling apparatus of a very large processing capacity with a multiple of production capacity by the number of bag making machines, thereby enabling single row feed of pouch 1 at a very high speed.

Figure 8:
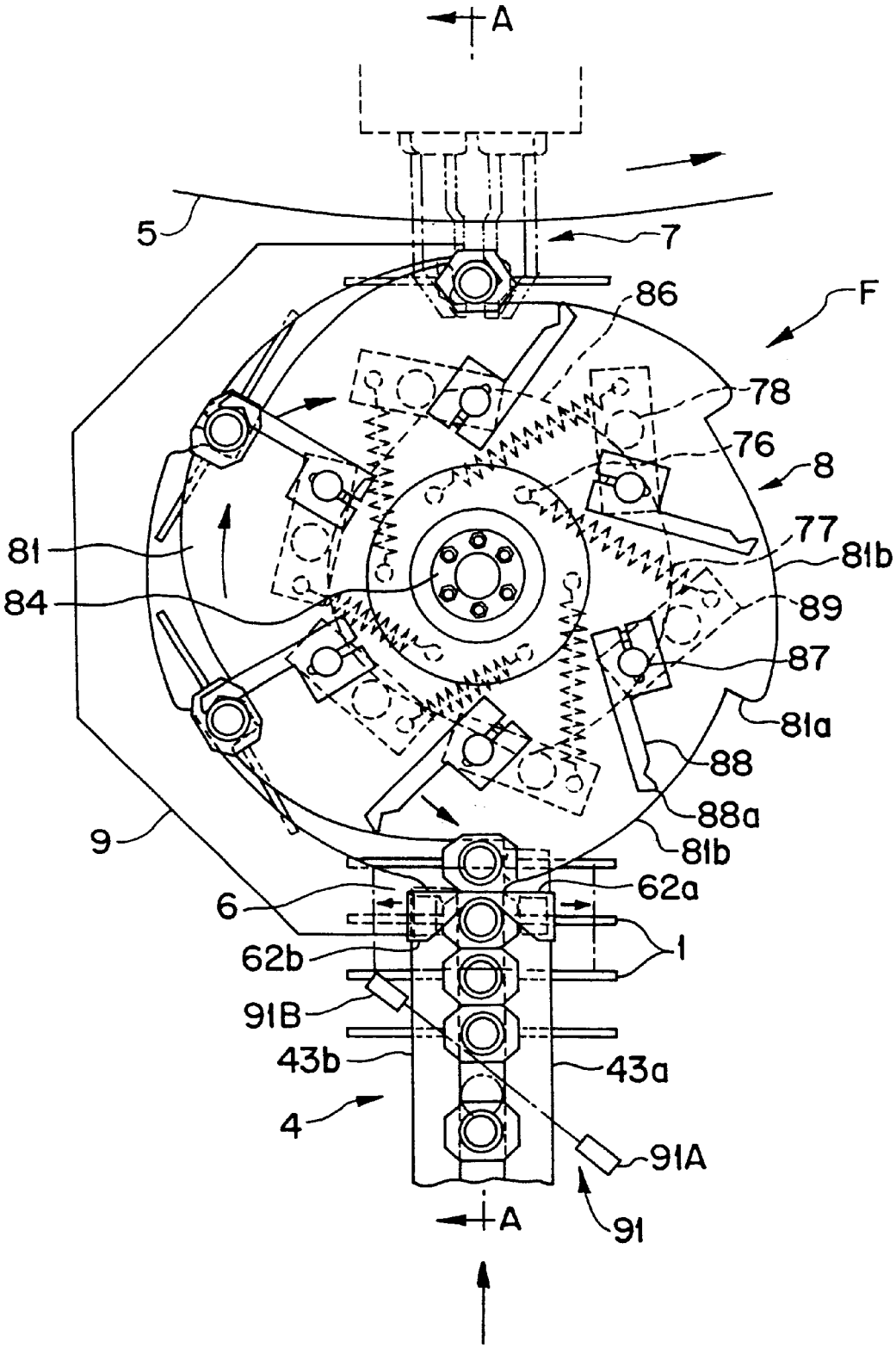
FIG. 8 is a schematic plane diagram showing the entire structure of the feeding apparatus of irregular-formed vessels according to an embodiment of the present invention.
Figure 9:
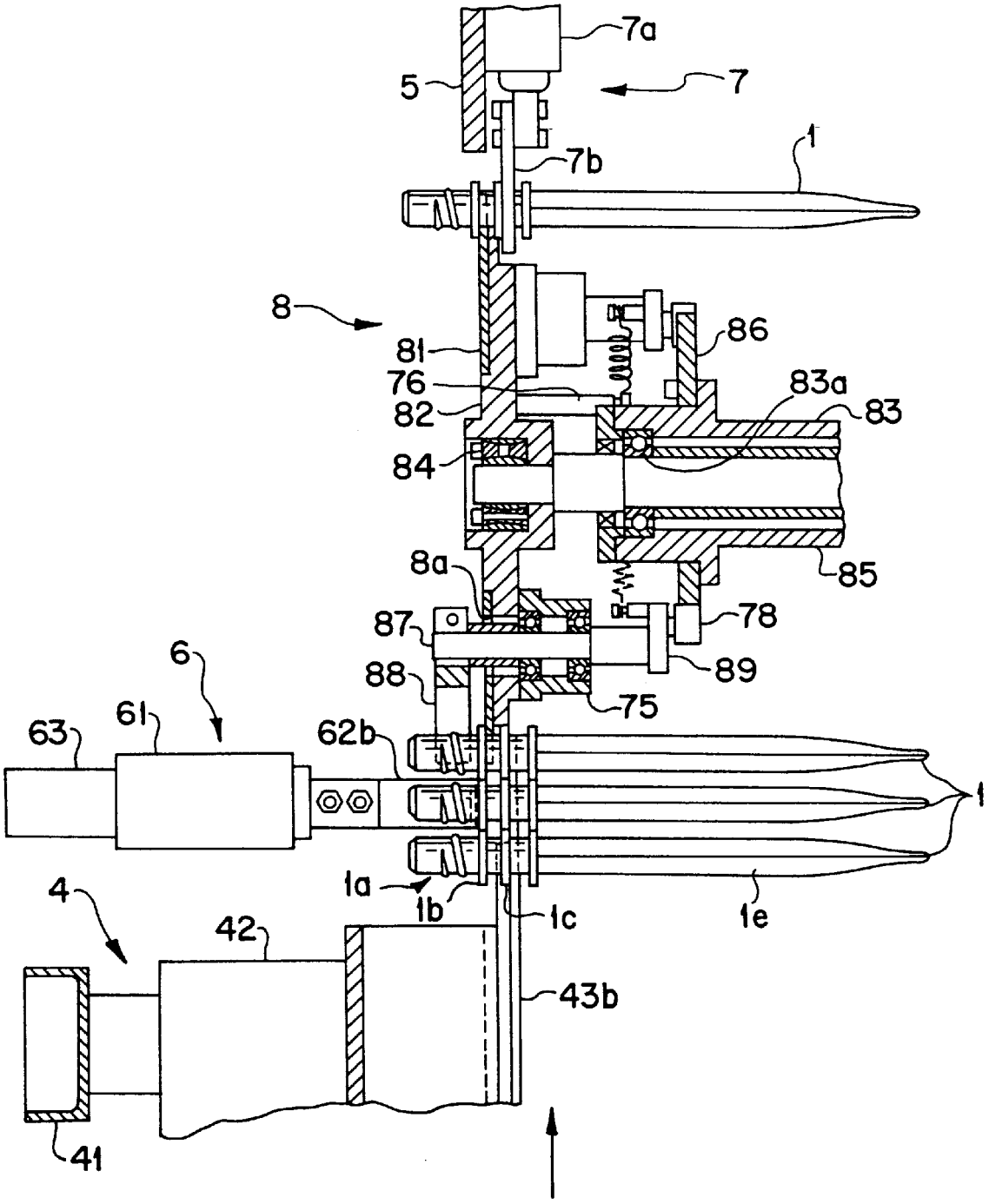
FIG. 9 is a schematic sectional diagram, taken along line A—A in FIG. 8, showing the structure of the apparatus shown in FIG. 8.
Figure 10:
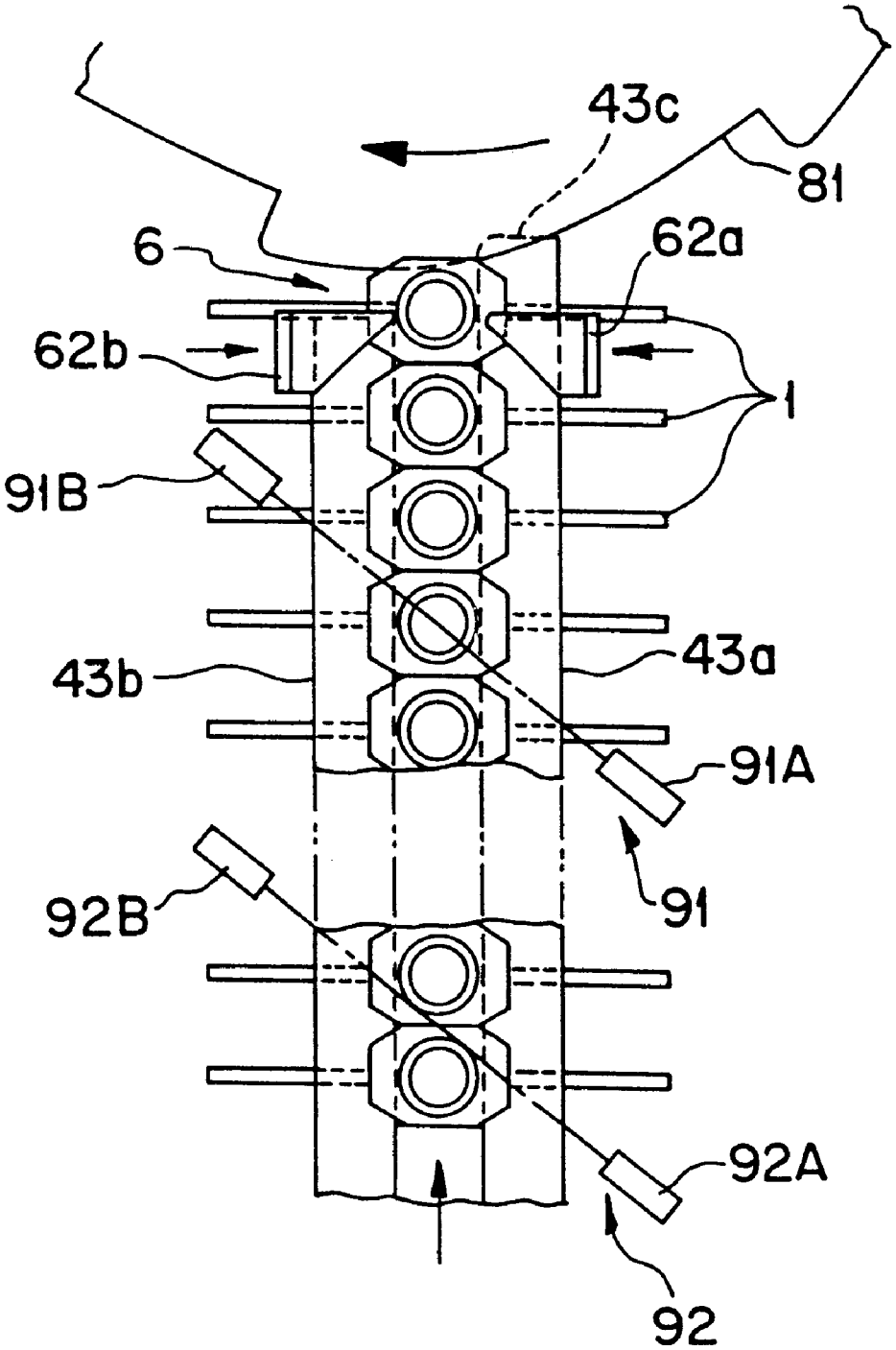
FIG. 10 is a schematic plane diagram showing the structure of part of feeding apparatus of irregular-formed vessels according to an embodiment of the present invention.

Next, the irregular-formed vessel feeding apparatus according to an embodiment of the present embodiment will be described with reference to FIGS. 8 to 10. FIG. 8 is a schematic plane diagram showing the entire structure thereof, FIG. 9 is a schematic sectional diagram (taken along line A—A in FIG. 8) showing the structure of part thereof, and FIG. 10 is a schematic plane diagram showing the structure of part thereof.

As shown in FIG. 8, the present vessel feeding apparatus F is disposed between the transportation trough (vibrating trough) 4 and the continuous rotation table 5 so that pouch 1 fed from the vibrating trough (vessel feeder) 4 at the upstream side (lower part in FIG. 8) is fed to the continuous rotating rotary filling apparatus 5 at the downstream side (upper part in FIG. 8). The vessel feeding apparatus F comprises a star wheel 8 as a transportation disk disposed between the transportation trough 4 and the continuous rotation table 5, an outlet part of the transportation trough 4, and an inlet part of the continuous rotation table 5.

The transportation trough 4 transports pouch 1 with arranged direction of body part 1*e* by hanging the flange part 1*c* (FIG. 6) of pouch 1 as the irregular-formed vessel with mouth plug and guiding on its opposing guide side surface 1*f*.

The transportation trough 4 of the present embodiment is supported through a vibrator 42 and a supporting member 41, the middle flange 1*c* of pouch 1 is hung on its trough plate 43*a* and trough plate 43*b* to transport pouch 1 by vibration in the feeding direction by the vibrator 42.

Further, as shown in FIG. 9 and FIG. 10, a tip 48*c* of trough plate 43*a* of one side extends to a position overlapping a hanging step 81*a* of an upper plate 81 of the star wheel 8, for ensuring transfer of pouch 1.

On the other hand, the continuous rotation table 5, as shown in FIG. 8 and FIG. 9, is provided with grippers 7 at a constant pitch. The gripper 7 engages with a horizontal cylindrical cam fixed to an outer member (not shown), and is provided with a mechanical chuck 7*a* for opening and closing a finger 7*b* of the vessel gripper 7 in parallel in the opposite directions when the continuous rotation table rotates and the filling apparatus reaches a position to receive pouch 1 and a position to discharge pouch 1.

The vessel feeding apparatus F is provided with a star wheel 8 as a transportation disk making continuous horizontal rotation to take up the flange part 1*b* from the chip of the transportation trough 4 and feed the pouch 1 as irregular-formed vessel with mouth plug to the continuous rotation table 5 of the continuously rotating rotary filling apparatus.

The star wheel 8, as shown in FIG. 9, fixes a star wheel main body 82 to a rotary shaft 83 by a fixing ring 84, and has an upper plate 81 fixed on the upper surface of the star wheel main body 82.

The rotary shaft 83 is rotatably journaled through a bearing 83*a* to a fixed shaft 85 fixed to a base (fixing member) of the star wheel 8 to make a predetermined rotation by a drive source (not shown).

That is, the rotary shaft 83 cooperates with the drive mechanism of the continuous rotation table of the filling apparatus, when the continuous rotation table 5 and the star wheel 8 are both making continuous rotation, at the contact point between both, rotation is synchronized so that the position of pouch 1 gripped by the star wheel 8 always coincides with the vessel receiving position of the vessel gripper of the continuous rotation table 5.

Further, the star wheel main body 82 is possible to make rotation for adjustment relative to the rotary shaft 83 by removing the fixing ring 84 to adjust relative position with respect to a holding release cam 86 by this rotation. That is, by providing the fixing ring 84, simple adjustment of transfer position of pouch 1 is possible.

On the upper plate 81 of the star wheel 8, as shown in FIG. 8, hanging steps 81*a* cut into the center side having an asymptotic plane smoothly changing from the bottom of the cut line to a spiral curve are formed at a predetermined plurality (8 positions in FIG. 8) of positions to take up the flange 1*b* and the guide side surface 1*f* of the mouth plug flange part.

Yet further, as shown in FIG. 8 and FIG. 9, on the upper surface of the upper plate 81 of the star wheel 8, a vessel neck pressing lever 88 for holding the upper part than the upper flange 1*b* in the mouth plug flange part is swingably provided to hold the mouth plug flange part in cooperation with the hanging step 81*a*.

That is, the vessel neck pressing lever 88 is fixed to a vertical rotary shaft 87 rotatably supported on the star wheel main body 82. The vertical rotary shaft 87, as shown in FIG. 9, is inserted in a hole 8*a* of the star wheel main body 82 and the upper plate 81, and rotatably mounted on a housing 75 fixed on the lower surface of the star wheel main body 82 through a bearing.

A holding spring 77 for urging the vessel neck pressing lever 88 in the holding direction of the mouth plug flange part is disposed between the star wheel main body 82 as a transportation disk and the vessel neck pressing lever 88. That is, a spring hanging rod 76 is provided on the bottom surface of the star wheel main body 82, and an operation lever 89 is fixed to the bottom end part of the vertical rotary shaft 87 to which the vessel neck pressing lever 88 is mounted, and a tension spring 77 is provided between the tip of the operation lever 89 and the spring hanging rod 76.

Here, the vessel neck pressing lever 88 and the operation lever 89 are mounted to have a predetermined relative angle (FIG. 8), so that the urging force of the tension spring 77 efficiently performs holding by the vessel neck pressing lever 88.

At the tip of the vessel neck pressing lever 88, as shown in FIG. 8, a claw 88*a* to facilitate holding the mouth plug flange part of pouch 1.

A plurality of sets (6 sets here) of the hanging step 81*a*, the vessel neck pressing lever 88 and the holding spring 77 are provided with the same pitch as the grippers 7 of the rotary filling apparatus.

Further, at the feeding position of pouch 1 to the rotary filling apparatus, a holding release cam 86 for swinging the vessel neck pressing lever 88 towards the holding release direction of the mouth plug flange part is fixed to the rotary filling apparatus.

That is, the holding release cam 86 is disposed beneath the star wheel main body 82 and fixed to the fixed shaft 85 to be fixed to the fixed part of the star wheel 8.

Outer peripheral profile of the holding release cam 86 engages with a cam follower 78 mounted to an intermediate part of the operation lever 89, through the cam follower 78, the operation lever 89 and the vessel neck pressing lever 88 are swung by the holding release cam 86.

The holding release cam 86 is formed of its cam profile, so that when the hanging step 81*a* approaches the gripper 7 of the filling apparatus, the vessel neck pressing lever 88 swings in the holding release direction, every time when the star wheel 8 rotates and each of the hanging step 81*a* approaches the gripper 7, holding release is performed.

Further, a vessel guide 9 is mounted on the outer periphery at one side of the upper plate 81 of the star wheel 8 with a constant spacing, to guide the pouch 1 not to come out from the route when the mouth plug part 1*a* of the vessel 1 is separate from binding by the vessel neck pressing lever 88 at receiving of pouch 1 to the star wheel 8 or transferring to the vessel gripper 7.

The transportation trough 4 is provided with pouch sensors 91 and 92 (23 in solid line FIG. 1) for detecting loading state of pouch 1.

These pouch sensors 91 and 92 comprise photoelectric sensors 91A and 92A and light sources 91B and 92B so that detection line between the light sources 91B and 92B and the photoelectric sensors 91A and 92A crosses passing surface of the mouth plug part of pouch 1 in horizontal diagonal direction.

As shown in FIG. 10, the pouch sensor 91 is provided at the downstream side of the transportation trough 4, and the pouch sensor 92 in the intermediate part of the transportation trough 4.

These pouch sensors 91 and 92 are mounted to an outer fixing member (not shown) which is not linked directly to the transportation trough 4 so that they are not affected by vibration of the transportation trough 4.

A pouch stopper 6 is provided for stopping forward movement of pouch by holding the vessel neck immediate before the head vessel in the transportation trough 4 until loading state in the transportation trough 4 is a predetermined state by the detection signal from the pouch sensors 91 and 92.

The pouch stopper provided at the vessel outlet of the transportation trough 4 comprises an air actuator 63, a mechanical chuck 61 driven by the air actuator 63 for opening and closing a pair of fingers in the opposite direction as is in parallel, a stopper plate 62*a* and a stopper plate 62*b* mounted to each of the pair of fingers of the mechanical chuck 61, and is mounted to an outer fixing member (not shown).

State of the pouch stopper 6 shown in FIG. 8 is when the air actuator 63 operates, and the stopper plate 62*a* and the stopper plate 62*b* approach each other by the same distances to stop pouch 1 at its mouth plug part 1*a*, state of the stopper 6 shown in FIG. 10 is when the air actuator 63 operates (or air of the air actuator 63 is removed, and the spring force of the incorporated return spring acts) the stopper plate 62*a* and the stopper plate 62*b* separate from each other by the same distances to separate from the vessel mouth plug part 1*a* of pouch 1 to free the pouch 1.

Therefore, when the pouch row is pressed to closely contact on the transportation trough 4, light is blocked and the pouch stopper 6 does not function, and the transportation trough continues pouch transportation.

On the other hand, when there is a space in the pouch row and the photoelectric sensor 91A detects light of the light source 91B in the pouch sensor 91, it is determined that the number of pouch 1 transported to the feeding apparatus is insufficient for generating a pressure to push out the head pouch 1, the pouch stopper 6 is operated so that the transportation operation trough 4 continues transportation, as is, but pouch feeding by the transportation trough 4 is stopped.

When the pouch row moves forward, light of the light source 91B is blocked by pouch 1, and the pouch sensor 91A detects the presence of pouch, the pouch stopper 6 opens to restart feeding of pouch 1.

When pouch 1 on the transportation trough 4 is excessive in amount, and pressure to the head pouch 1 is too large, the mouth plug part 1*a* of pouch 1 strongly contacts against the asymptotic plane 81*b* of the upper plate 81 of the star wheel 8 to be dragged in the rotation direction, and there is a possibility to be bit between the upper plate 81 and the vessel guide 9, however, in this case, as shown in FIG. 10, the pouch sensor 92 provided in the intermediate part of the transportation trough 4 detects overload of pouch 1, the pouch stopper 6 is operated according to the detection to reduce pressure of head pouch 1 of the transportation trough 4.

By opening and closing the pouch stopper 6 in synchronization with passage of the hanging step 81*a* in the star wheel 8, the mouth plug part 1*a* of pouch 1 is prevented from being dragged by the upper plate 81 of the star wheel 8.

As shown above, by detecting the amount of pouch on the transportation trough 4 and controlling the pressure of pouch row in an appropriate range, pouch feeding can be ensured.

Since the feeding apparatus of irregular-formed vessels as an embodiment of the present invention is constructed as described above, it makes the following operation.

First, pouch 1 as an irregular-formed vessel arranged in the direction and fed by the transportation trough 4 are taken up at the hanging step 81*a* of the star wheel 8 as a transportation disk.

When the star wheel rotates and the hanging step 81*a* of the upper plate 81 takes up pouch 1 at the tip of the transportation trough 4, next pouch 1 on the transportation trough 4 is pressed in the feeding direction of the transportation trough 4, slowly slides on the asymptotic plane 81*b* of the upper plate 81 until it is taken up by the next hanging step 81*a*.

When the hanging step 81*a* of the upper plate 81 takes up pouch 1 at the tip of the transportation trough 4, engagement position of the cam follower 78 to the holding release cam 86 is moved from the high profile to the low profile of the cam 86, and the vessel neck pressing lever 88 holds the mouth plug part 1*a* by the urging force of the tension spring and rotates.

Next, when the star wheel 8 is rotated and pouch 1 reaches the feeding position to the rotary filling apparatus, by the holding release cam 86, the vessel neck pressing lever 88 is swung in the holding release direction, and pouch 1 is fed to the rotary filling apparatus.

That is, when the hanging step 81 of the upper plate 81 reaches a position to contact with the gripper 7 of the rotary filling apparatus, engagement position of the cam follower 78 to the holding release cam 86 moves from the low profile to the high profile, and the vessel neck pressing lever 88 rotates in the direction to release the mouth plug part 1*a* against the urging force of the tension spring 77.

The gripper 7 of the filling apparatus opens the finger 7*b* by the function of the horizontal annular cam fixed on an outer fixing member (not shown) to receive the mouth plug part 1*a*, immediately closes to hold pouch 1 so that the body part 1*c* is arranged in the circumferential direction by the opposite guide side surface If between the middle flange 1*c* and the lower flange 1*d*.

For feeding of pouch 1 in the transportation trough 4, the following operation is performed.

First, when the pouch row is pressed and closed contacted on the transportation trough 4, light from the light source 91B to the photoelectric sensor 91A is blocked in the pouch sensor 91, the pouch stopper 6 does not operate, and the transportation trough 4 continues pouch feed.

On the other hand, when there is a space in the pouch row and the photoelectric sensor 91A detects light from the light source 91B, it is determined that the amount of pouch 1 transported to the feeding apparatus is insufficient for generating a pressure to push out the head pouch 1, the pouch stopper 6 is operated so that the transportation operation trough 4 continues transportation, as is, but pouch feeding by the transportation trough 4 is stopped.

When the pouch row moves forward, light of the light source 91B is blocked by pouch 1, and the pouch sensor 91A detects the presence of pouch, the pouch stopper 6 opens to restart feeding of pouch 1.

When pouch 1 on the transportation trough 4 is excessive in amount, and pressure to the head pouch 1 is too large, the mouth plug part 1*a* of pouch 1 strongly contacts against the asymptotic plane 81*b* of the upper plate 81 of the star wheel 8 to be dragged in the rotation direction, and there is a possibility to be bit between the upper plate 81 and the vessel guide 9, however, in this case, as shown in FIG. 10, the pouch sensor 92 in the middle of the transportation trough 4 detects overload of pouch 1 from blocking of light from the light source 92B, and the pouch stopper 6 is operated to reduce pressure of head pouch 1 of the transportation trough 4.

The pouch stopper 6 is opened and closed in synchronization with passage of the hanging step 81*a* in the star wheel 8, the mouth plug part 1*a* of pouch 1 is prevented from being dragged by the upper plate 81 of the star wheel 8.

As shown above, by detecting the amount of pouch on the transportation trough 4 and controlling the pressure of pouch row in an appropriate range, pouch feeding is ensured.

As described above, since the pouch of irregular-formed body part and having a small head like mouth plugged pouch 1 cannot hang the timing screw, it has been difficult that pouch transfer timing is synchronized with the continuously rotating rotary filling apparatus and making feed while maintaining the arranged direction of the pouch body part, however, the pouch 1 is fed by pushing while guiding the mouth plug part 1*a* in the transportation trough 4, after pouch 1 is pulled in one by one by the plurality of equal pitch hanging steps through the spiral asymptotic plane connecting the body hanging step and the upper edge part of the adjacent hanging step of the star wheel 8, by taking out the mouth plug part of pouch from the transportation disk And transferring it to the filling apparatus, smooth pouch feed as timing screw is possible.

Further, there is an advantage that since the mouth plug part of pouch 1 is held by the opening and closing pressing lever, feeding of pouch 1 can be performed stably and at a high speed while maintaining the direction of pouch 1 with mouth plug and while preventing the mouth plug part 1*a* of pouch 1 from deviating to the asymptotic plane of the of the star wheel.

Still further, by using the pouch sensors 91 and 92 to detect the pouch amount on the transportation trough 4 and controlling open/close timing of the pouch stopper 6, pressure of the pouch row can be regulated in an appropriate range to ensure feeding of pouch 1, preventing generation of an excessive pressure on the asymptotic plane of the star wheel 8.

As described above, with the feeding apparatus and feeding method of irregular-formed vessels, continuous feed of mouth-plugged irregular-formed vessels suitable for the continuously rotating rotary filling apparatus is ensured.

Yet further, the feeding apparatus and feeding method of irregular-formed vessels according to the present invention is not limited to the above described embodiments such that the transportation trough 4 is not limited to a vibration trough, various modifications are possible without departing from the spirit and scope of the present invention.

Next, an embodiment of the filling apparatus of irregular-formed vessels according to the present invention is shown in FIGS. 11 to 14.

Figure 11:
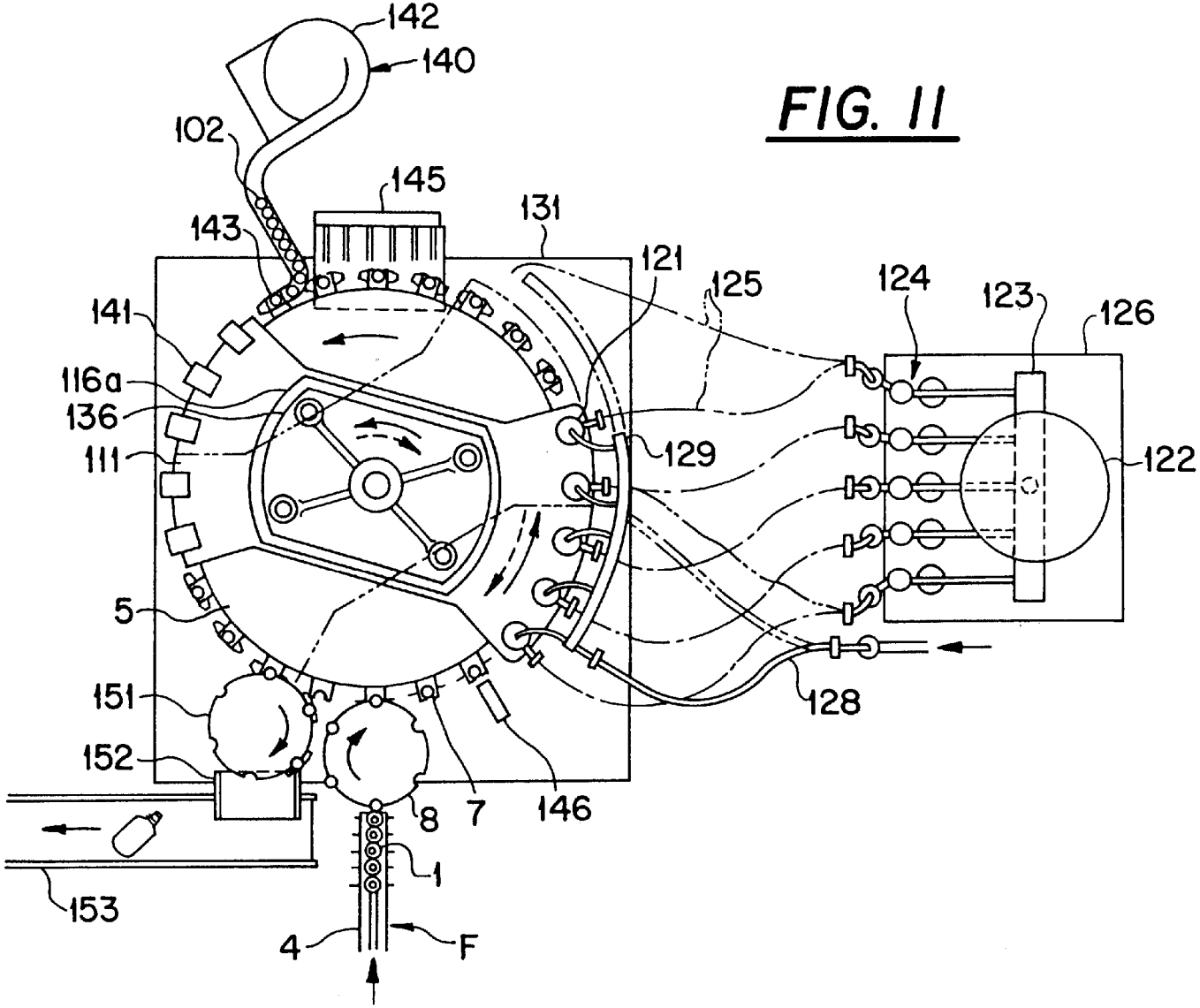
FIG. 11 is a plane diagram of the filling apparatus of irregular-formed vessels according to an embodiment of the present invention.
Figure 12:
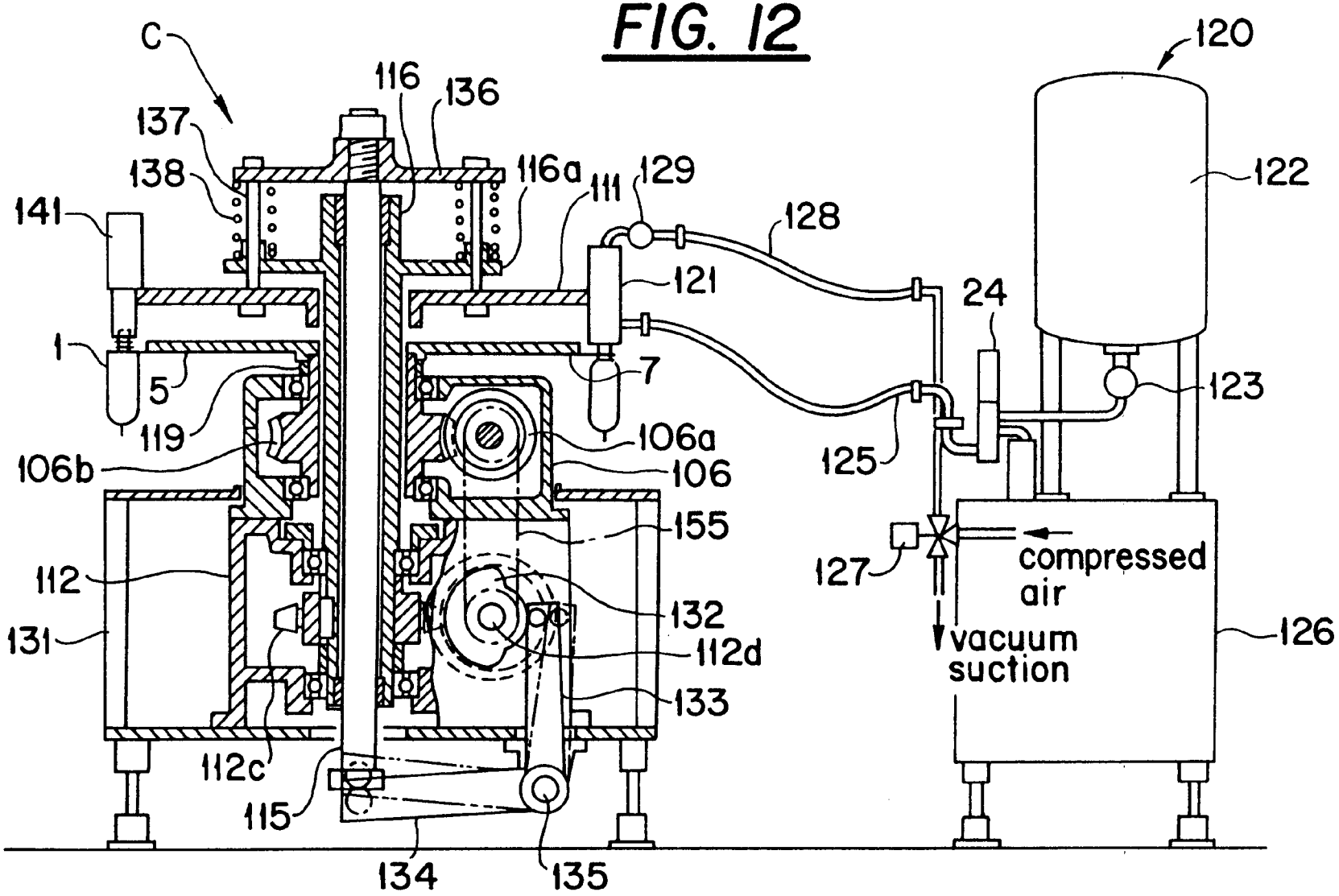
FIG. 12 is a sectional structural diagram as viewed from the side surface of FIG. 11.
Figure 13:
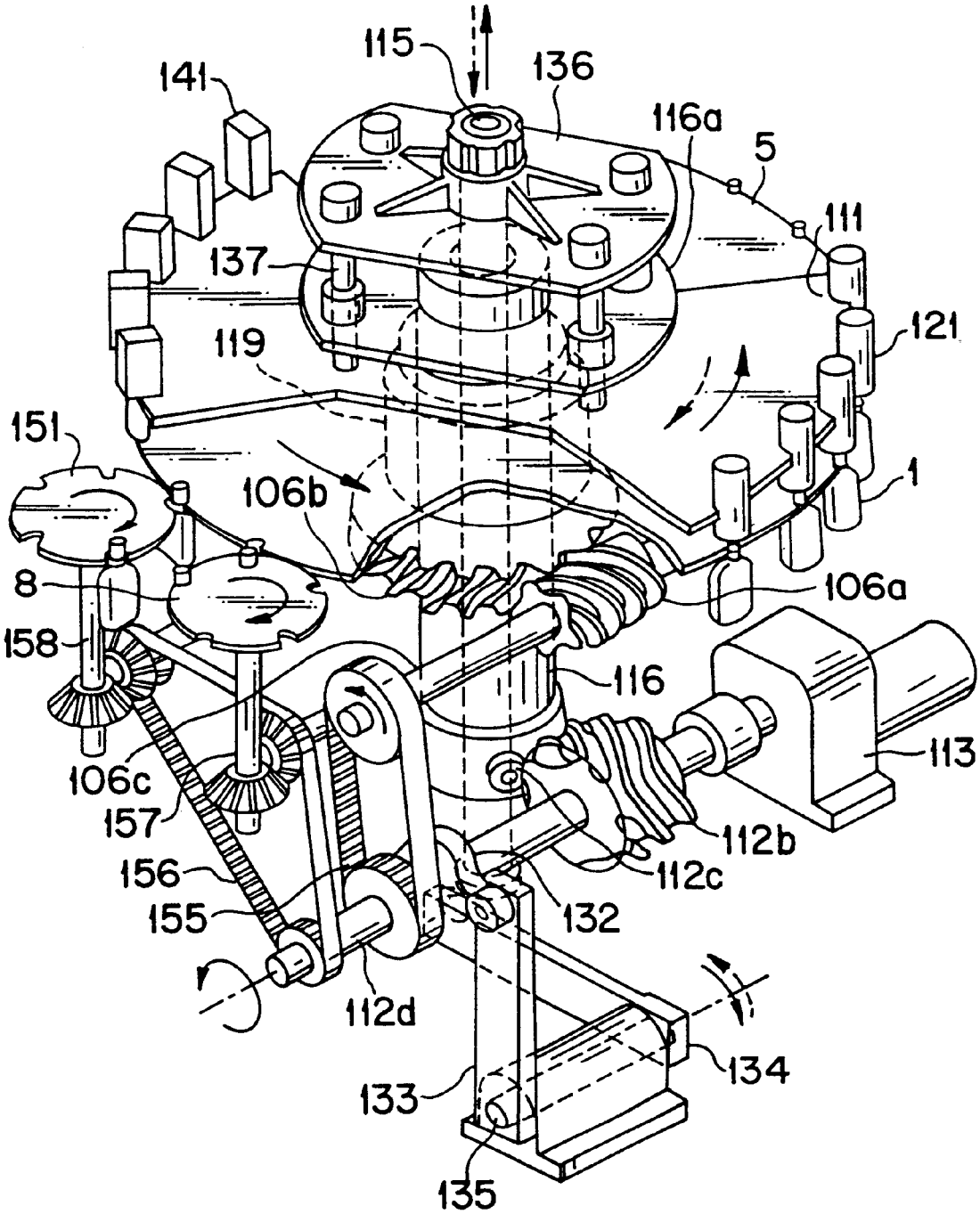
FIG. 13 is a perspective diagram of drive system as a main part of FIG. 12.
Figure 14:
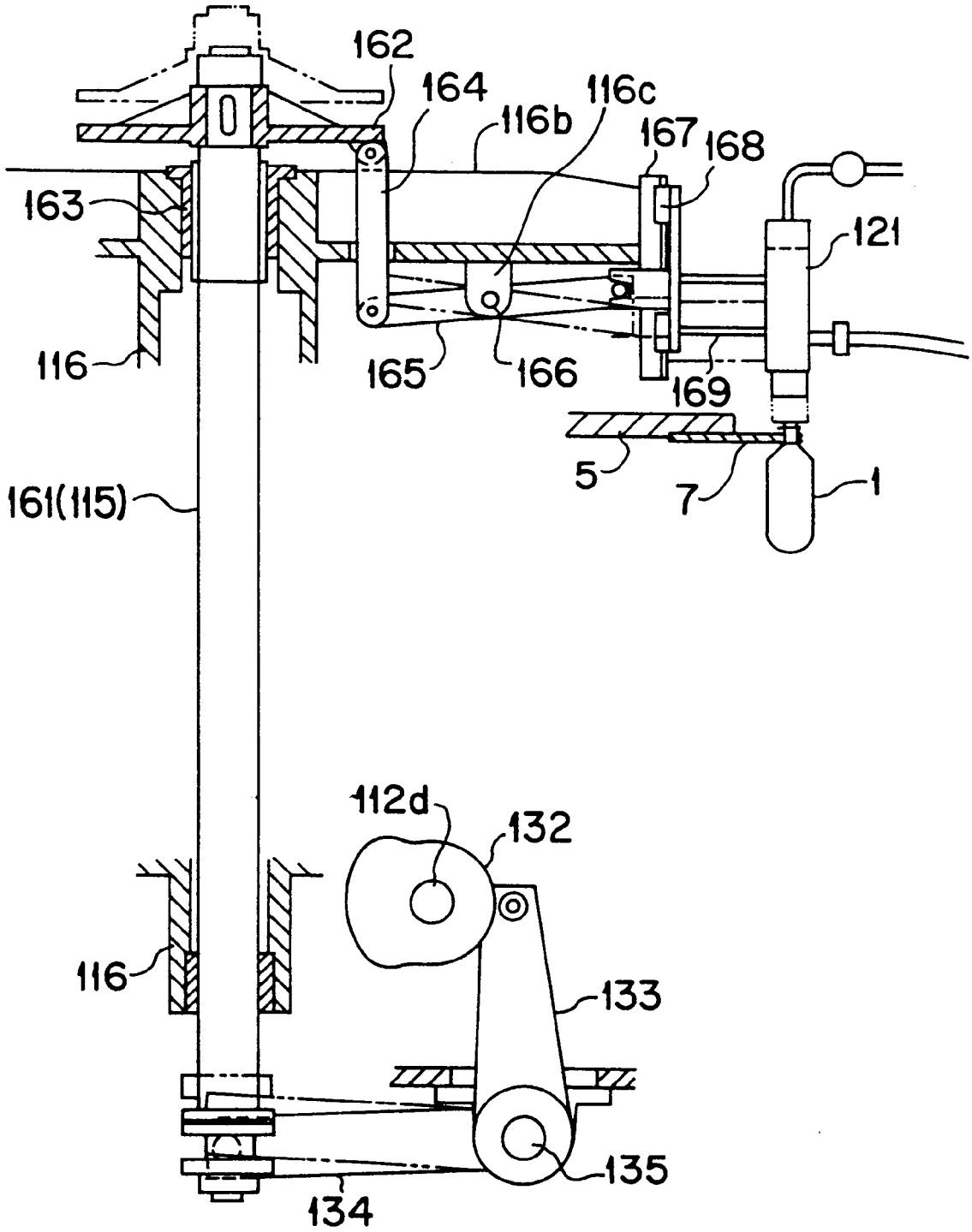
FIG. 14 is a side surface sectional diagram of a modified example.

In the present embodiment, mouth-plugged pouch fed from outside is received into the irregular-formed vessel filling apparatus, the vessel is supported at the flange provided at the neck part of the pouch by the gripper provided on the continuous rotation table, while being continuously rotated and being fed, filling with a liquid and capping are performed, and discharged to the discharge conveyor. Here, the present embodiment will be described with reference to FIGS. 11 to 14. FIG. 11 is a plane diagram as viewed from the upper surface, showing various apparatus for vessel feeding, liquid filling, vessel washing, capping, and vessel discharge in addition to the table main body, FIG. 12 is a sectional structural diagram as viewed from the side surface, showing driving of the table and apparatus for liquid filling, FIG. 13 is a perspective diagram for easy understanding of table driving, and FIG. 14 shows star wheel driving.

In FIG. 11, numeral 1 indicates a pouch, F is a vessel feeding apparatus, and the vessel feeding apparatus 3 is a combination of the vibrating trough 4 with the star wheel 8. Empty pouch 1 having a plate-like body part is carried in with the same state of body surfaces stacked on the transportation 4, engaged as described above with the continuously rotating star wheel 8 while being direction regulated so that the plate-like body surface is the same as the feeding direction at the tip of the trough 4, and transferred. The peripheral speed of the star wheel 8 is the same as the peripheral speed of the continuous rotation table 5, the groove engaging with pouch 1 of the star wheel 8 is adapted to coincide with the gripper 7 of the continuous rotation table 5 at the contact point with the continuous rotation table, at this contact point empty pouch 1 is transferred from the star wheel 8 to the gripper 7 of the continuous rotation table 5. The gripper 7, when approaching the contact point (feed position), opens and closes by releasing the plate cam (FIG. 8) to receive and grip pouch 1. In this operation, opening and closing by the plate cam is the same as receiving by a take-out star wheel 151 which will be described later.

The continuous rotation table 5, relative to pouch 1 gripped by the gripper 7, is rotated to make printing production date, and quality maintaining period and the like, liquid filling, vessel washing, and capping sequentially, and a returning (swinging) intermittent swinging table 111 is driven in synchronization with the continuous rotation table 5 to make liquid filling and capping of a plurality of vessels collectively.

Here, the drive system will be described with reference to FIG. 12 and FIG. 13. The continuous rotation table 5 is driven by a drive unit 106. The drive unit 106 is a hollow reducer, in which a shaft 106*c* transmitted with a driving force by a gear and toothed belt 155 from a rotary shaft 112 directly connected to a motor 113 is used as an input shaft, which is connected directly to an outer hollow shaft 119 through a worm 106*a* and a wheel 106*b*. Therefore, by driving of the motor 113 shown in FIG. 13, rotation force is transmitted and reduced to rotate the outer hollow shaft 119, thereby rotating the continuous rotation table 5. Therefore, since a number of grippers 7 are provided at a constant pitch on the periphery of the continuous rotation table 5, in association with rotation, the grippers 7 grip the neck of pouch 1 and make continuous rotation.

The intermittent swinging table 111 disposed above the continuous rotation table 5 provided with a filling nozzle for making liquid filling to pouch 1 gripped by the gripper 7 and a capping head 141 for making cap tightening is provided, the intermittent swinging table 111 can be rotated by a drive unit 112 through a hollow shaft 116 coaxially disposed inside the above-described outer hollow shaft 119, a support plate 116*a* integrally connected with the hollow shaft 116, and a hanging rod 137 mounted on the support plate 116*a*. The drive unit 112 comprises an oscillating unit provided on a shaft 112*d* of the motor 113 shown in FIG. 13, rotation is transmitted by a cam 112*b* (FIG. 13) provided on the shaft 112*d*, and a taper roller 112*c* on the hollow shaft 116 engaging with the cam 112*b*. In this case, the forward moving step is formed by an equal speed cam, and the return step is formed by a modified sinusoidal cam. As a result, by the driving of the motor 113, the hollow shaft 116 rotates by the movement of the taper roller 112*c* on the cam 112*b*, and the intermittent swinging table 111 is reciprocally rotated, that is, swung. The intermittent swinging table 111 is provided with filling nozzles 121 and capping heads 141 of a number of about ⅕ the number of the gripper 7 of the continuous rotation table 5, and these nozzles and the heads 141 are mounted at the same radial position and with the same pitch as pouch 1 gripped by the gripper 7 of the continuous rotation table 5.

Since, as described above, the drive unit 106 of the continuous rotation table 5 and the drive unit 112 of the intermittent swinging table 111 are mechanically connected with the output shaft 112*d* of the same motor 113, the continuous rotation table 5 and the intermittent swinging table 111 can be rotated in synchronization with each other in the forward direction in the state where positions of the filling nozzle 121 and the capping head 141 of the intermittent swinging table 111 are in line with the position of pouch 1 (gripper 7) of the continuous rotation table 5, and the intermittent swinging table 111 is quickly returned, so that movement of next rotating pouch group can be positioned next to formerly following pouch group. (In FIG. 11, the solid line indicates the position at the beginning of equal speed rotation of the intermittent swinging table 111, and the two-dot-bar line indicates the end position of equal speed rotation.)

Inside the hollow shaft 116, a vertical moving shaft 115 penetrates, an upper support plate 136 is fixed to an upper part of the vertical moving shaft 115, the plurality of hanging rods 137 are hung while penetrating holes provided in the upper support plate 136, and the intermittent swinging table 111 is mounted on a lower part of the hanging rods 137. A compression spring 138 urged about the hanging rod 117 is provided between the support plate 116 and the upper support plate 136. The compression spring 138 is provided to support the weight of the vertical moving shaft 115, the intermittent swinging table 111 and its accessory parts, for reducing the load applied to a vertical moving cam 132 as a means for vertically moving the vertical moving shaft 115 and the operation levers 133 and 134 for intermediating the movement of vertical moving cam 132.

The vertical moving cam 132 mounted on the shaft 112*d* of the motor 113 vertically moves the vertical moving shaft 115 through the shaft 133 and the lever 134 and vertically moves the intermittent swinging table 111 through the upper support plate 136 and the hanging rod 138. Since the vertical moving cam 132 is driven by rotation of the motor 113 to vertically move the vertical moving shaft 115, consequently the intermittent swinging table 111 is moved up at a constant rotation angle and moved down at the remaining rotation angle. That is the rotation speed of the intermittent swinging table 111 coincides with the rotation speed of the continuous rotation table 5, the profile of the vertical moving cam 132 can be formed so that when the position of the filling nozzle 121 and the capping head 141 is in line with the position of pouch 1 of the continuous rotation table 5, the intermittent swinging table 111 is moved down to make liquid filling and tightening of cap 102 and moved up immediately before quick return of the intermittent swinging table 111.

Further, a gear provided integrally with the shaft 112*d* of the motor 113 is engaged with a gear for rotating the respective rotation shafts 157 and 158 of the star wheel 8 and the take-out star wheel 151 by the toothed belt 156. Therefore, rotation of the motor 113 can rotate the star wheels 8 and 151 so that the grooves of the star wheel 8 and 151 are coincided with the grippers 7 of the continuous rotation table 5.

As shown above, rotation force of the motor 113 is transmitted to the shaft 112*d,* and rotates the outer hollow shaft 119 and the continuous rotation table 5 through the shaft 106*c,* the worm gears 106*a* and 106*b* in the drive unit 106, reciprocally rotates (swings) the hollow shaft 116, the support plate 116*a,* and the intermittent swinging table 111 through the drive unit 112 as an oscillating unit, vertically moves the vertical moving shaft 115, the upper support plate 136, the hanging rod 137, and the intermittent swinging table 111 by the rotation of the vertical moving cam 132, and the levers 133 and 134, and rotates the star wheels 8 and 151 through the gears. Relation between rotation and vertical movement of various drive systems is such that in the continuous rotation table 5 and the intermittent swinging table 111, pouch 1, filling nozzle 121 and the capping head 141 are set at the same position and rotated in synchronization, after quick return of the intermittent swinging table 111, position of the pouch 1, and position of the filling nozzle 121, and the capping head 141 are coincided, in the intermittent swinging table 111 and the vertical moving shaft 115, when the position of pouch 1 coincides with the position of the filling nozzle 121 and the capping head 141, the intermittent swinging table 111 is moved down and moved up immediately before quick return of the intermittent swinging table 111, and the continuous rotation table 5 and the star wheels 8 and 151 are rotated so that pouch grooves of the star wheels 8 and 151 coincide with the grippers 7.

Next, liquid filling will be described with reference to FIG. 11 and FIG. 12. Separately disposed liquid measuring vessels 124 are provided on a liquid tank table 126 in a same number as the plurality of filling nozzles 121, a liquid tank 122 is provided on the liquid tank table 126, a manifold tube 123 communicating with a liquid tank 122 is provided at the lower part of the liquid tank 122, and liquid tubes branched from the manifold tube 123 are connected to the liquid measuring vessels 124. The liquid measuring vessels 124 and the filling nozzles 121 are connected with flexible hoses for filling liquid.

At the same timing when the filling nozzle contacts the mouth of empty pouch 1, liquid in a constant amount measured by the piston and cylinder of the measuring vessel 124 is conducted to the filling nozzle through the flexible hose 125 and filled in the pouch.

Each filling nozzle 121 is connected with an air pipe branched from the air manifold tube 129, and the manifold tube 129 is connected by an air flexible hose 128 to a 3-way switching valve provided on the liquid tank table 126. The 3-way switching valve 127 is connected with a compressed air supply tube and a vacuum suction tube, the 3-way switching valve 127 is operated for vacuum suction to evacuate air in pouch 1, then the 3-way switching valve 127 is switched to compressed air to open the liquid passage by air cylinder operation and, at the same time, a check valve provided in the air passage incorporated in the nozzle 121 is operated to close the air passage.

As shown in FIG. 11, when the filled vessel on the continuous rotation table separates from the filling section and rotates, outside under the neck of pouch 1 is washed with washing water by a fixed pouch sensor 145.

A capping device 140 is provided at the washing completion position, the capping device comprises a cap selector 142 for arrange the direction of cap 102, a chute for sequentially feeding the arranged cap 102, and a cap catcher 143, Next, the cap put on the mouth plug part of pouch 1 is tightened by the capping head 141 mounted at the symmetrical position with the filling nozzle on the intermittent swinging table 111. That is, the cap 102 put on the mouth plug part of pouch 1 is chucked by downward movement of the capping head 141, and tightened all at once by driving the electric motor or air motor provided on each capping head 141.

The cap tightened pouch 1 is separated from the continuous rotation table 5 by opening the gripper by a fixed plate cam (not shown), taken out by the take-out star wheel 151 of the same peripheral speed, fallen to a discharge chute, and discharged on a discharge conveyor 153 to the next process.

FIG. 14 shows a modification example of vertical movement of the intermittent swinging table. FIG. 14 is a construction effective for a case where the amount of pouches processed on the respective table of the filling apparatus is large, the vertical moving shaft 115, the intermittent swinging table 111 and its accessory parts shown in FIG. 12 are substantially large in weight, and the load applied to the vertical moving cam 132 and operation levers 133 and 134 driven by the cam cannot be reduced only by the above-described plurality of compression springs 138.

Most of the vertical moving shaft 115 in FIG. 12 have vertical moving shafts 161 of a common shape, and at the upper part have a ball spline 163 for binding the rotational direction of the hollow shaft 116 and making it movable in the axial direction. An upper disk 162 is mounted on the upper part of the vertical moving shaft 161.

A support shaft 166 is provided on a support table 116*c* mounted at the lower part of the support plate (intermittent swinging table) 116*b* which integral with the hollow shaft 116, a reverse lever 165 is rotatably supported on the support shaft 166, inside end of the reverse lever 165 is connected with the upper disk 162 mounted on the upper end of the vertical moving shaft 161 through a pin joint bar 164, and the outside end part has a roller. Since a vertical guide 167 is mounted to the support plate 116*b,* the filling nozzle 121 and the capping head 141 are mounted to be vertically slidable on the vertical guide 167, and engage the roller of the reverse lever 165, the filling nozzle 121 and the capping head 141 vertically move in the opposite direction to the movement of the vertical moving shaft 161 which is vertically moved by the vertical moving cam 132. (In FIG. 14, the solid lines indicate the position when the filling nozzle 121 and the capping head 141 move up, and the two-dot-bar lines indicate the position whey they move down.) As shown above, the weight at the vertical moving shaft 161 side and the weight of the filling nozzle 121 and the capping head 141 are balanced, so that load applied to the vertical moving cam 132 is reduced, thereby enabling operation of reduced load variation.

In the above description, the pouch neck is passed and hung through the gripper of the continuous rotation table, however, alternatively, a self-standing bottle or the like may be supported at the bottom part and fed while being direction regulated by a side guide.

UTILIZABILITY IN INDUSTRY

As described above, with the present invention, in a series of operation of a filling apparatus in which irregular-formed vessels from irregular-formed vessel making machines are transported, fed to the rotation table, and filled, irregular-formed vessels from bag making machines of small production capacities are being combined to a filling apparatus of a large processing capacity to feed the irregular-formed vessels continuously to the filling apparatus, thereby making continuous processing by a simple structure.

What is claimed is:

1. A transportation apparatus of irregular-formed vessels comprising:

a plurality of bag making machines for continuously producing irregular-formed vessels having a flanged mouth plug;

a plurality of transportation troughs connected to said respective plurality of bag making machines;

a single-row transportation trough for combining into a single row and transporting said irregular-formed vessels fed from said respective transportation troughs;

a plurality of relay movable troughs disposed respectively corresponding to said plurality of transportation troughs, by a predetermined movement, inlets being connected to outlets of corresponding transportation troughs capable of containing a predetermined amount of irregular-formed vessel from said corresponding transportation trough, and by another predetermined movement, outlets being connected with inlet of said single-row transportation trough for discharging the contained irregular-formed vessels to said single-row transportation trough;

wherein when an outlet of any one of said plurality of relay movable troughs is connected with an inlet of said single-row transportation trough movement of said plurality of relay movable troughs is cooperatively performed so that inlets of other relay movable troughs of said plurality of the relay movable troughs are connected with outlets of the transportation troughs respectively corresponding to said relay movable troughs.

2. A transportation apparatus of irregular-formed vessels comprising;

a first bag making machine and a second bag making machine for continuously producing irregular-formed vessels having a flanged mouth plug;

a first transportation trough connected to said first bag making machine;

a first transportation trough connected to said first bag making machine;

a single-row transportation trough for combining into a single row and transporting irregular-formed vessels fed from said first transportation trough and irregular-formed vessels fed from said second transportation trough;

a first relay movable trough having an inlet capable of being connected to an outlet of said first transportation trough by a predetermined movement for containing a predetermined amount of irregular-formed vessels from said first transportation trough, and having an outlet capable of being connected with an inlet of said single-row transportation trough by another predetermined movement for discharging the contained irregular-formed vessels to said single-row transportation trough; and a second relay movable trough having an inlet capable of being connected with an outlet of said second transportation trough by a predetermined movement for containing a predetermined amount of irregular-formed vessels from said second transportation trough and having an outlet capable of being connected with said single-row transportation trough for discharging the contained irregular-formed vessels to the single-row transportation trough;

wherein said relay movable trough and said second relay movable trough are constructed to cooperate with each other so that said second relay movable trough and said single-row transportation trough are connected when said first transportation trough is connected with said first relay movable trough and said first relay movable trough and said single-row transportation trough are connected when said second transportation trough is connected with said second relay movable trough.

3. A transportation method of irregular-formed vessels using a plurality of bag making machines for continuously producing irregular-formed vessels having a flanged mouth plug, a plurality of transportation troughs connected respectively to said plurality of bag making machines, a single-row transportation trough for combinedly transporting the irregular-formed vessels discharged from said respective transportation troughs in a single row, a plurality of relay movable troughs disposed corresponding to said plurality of transportation troughs capable of containing a predetermined amount of irregular-formed vessels from said transportation troughs and discharging the contained irregular-formed vessels to said single-row transportation trough;

having an operation process wherein one of said plurality of relay movable troughs is selected, said relay movable trough is moved to connect an output of said relay movable trough to an inlet of said single-row transportation trough to discharge the irregular-formed vessels contained in the relay movable trough to the single-row transportation trough, other of said plurality of relay movable troughs are appropriately moved to be connected with output of the corresponding transportation trough containing a predetermined amount of irregular-formed vessels from said transportation trough in said relay movable trough, while switching a relay movable trough selected from said plurality of relay movable troughs to be connected to said single-row transportation trough, said operation process is repeated to successively transport a predetermined amount of irregular-formed vessels from said respective transportation troughs through said single-row transportation trough.

4. A transportation method of irregular-formed vessels using a first bag making machine and a second bag making machine for continuously producing irregular-formed vessels having a flanged mouth plug, a first transportation trough connected with said first bag making machine, a second transportation trough connected with said second bag making machine, a single-row transportation trough for combinedly transporting the irregular-formed vessels discharged from said first transportation trough and the irregular-formed vessels discharged from said second transportation trough in a single row, a first relay movable trough capable of containing a predetermined amount of irregular-formed vessels from said transportation trough and discharging the contained irregular-formed vessels to said single-row transportation trough, and a second relay movable trough capable of containing a predetermined amount of irregular-formed vessels from said transportation trough and discharging the contained irregular-formed vessels to said single-row transportation trough, having a first operation, wherein by a predetermined movement, an inlet of said first relay movable trough is connected to an output of said first transportation trough to contain a predetermined amount of irregular-formed vessels from said first transportation trough and, at the same time, an output of said second relay movable trough is connected to an inlet of said single-row transportation trough to discharge the irregular-formed vessels contained in said second relay movable trough to said single-row transportation trough, and a second operation, wherein by another predetermined movement, an outlet of said first relay movable trough is connected to an inlet of said single-row transportation trough to discharge the irregular-formed vessels contained in said first relay movable trough to said single-row transportation trough and, at the same time, an inlet of said second relay movable trough is connected to an outlet of said second transportation trough to contain a predetermined amount of irregular-formed vessels from said second transportation trough into said second relay movable trough, said first operation and said second operation being repeated to successively transport a predetermined amount of irregular-formed vessels from said first transportation trough and a predetermined amount of irregular-formed vessels from said second transportation trough in alternation through said single-row transportation trough.

* * * * *